US008496129B2

(12) United States Patent
Isogai et al.

(10) Patent No.: US 8,496,129 B2
(45) Date of Patent: Jul. 30, 2013

(54) CAP AND COVERED CONTAINER

(75) Inventors: Takamitsu Isogai, Tokyo (JP); Masayuki Someya, Tokyo (JP)

(73) Assignee: Tokan Kogyo Co, Ltd., Tokyo (JP)

( * ) Notice: Subject to any disclaimer, the term of this patent is extended or adjusted under 35 U.S.C. 154(b) by 0 days.

(21) Appl. No.: 13/557,760

(22) Filed: Jul. 25, 2012

(65) Prior Publication Data

US 2012/0285922 A1 Nov. 15, 2012

Related U.S. Application Data

(62) Division of application No. 12/298,751, filed as application No. PCT/JP2007/059192 on Apr. 27, 2007, now Pat. No. 8,235,232.

(30) Foreign Application Priority Data

Apr. 28, 2006 (JP) ..... 2006-126161
Dec. 4, 2006 (JP) ..... 2006-327006

(51) Int. Cl.
*B65D 41/34* (2006.01)
*B65D 17/44* (2006.01)

(52) U.S. Cl.
USPC ..... 215/256; 215/48; 215/253; 222/541.5; 222/541.6; 222/541.2; 222/83; 220/277

(58) Field of Classification Search
USPC .... 215/47, 48, 49, 50, 227, 253, 256; 222/81, 222/83, 541.1, 541.2, 541.5, 541.6; 220/277
See application file for complete search history.

(56) References Cited

U.S. PATENT DOCUMENTS 4,111,325 A 9/1978 Bellamy et al.
4,402,415 A * 9/1983 Hopley ..... 215/48

(Continued)

FOREIGN PATENT DOCUMENTS

JP 2005-082203 A 3/2005
KR 10-2004-96997 11/2004

OTHER PUBLICATIONS

Zenzo Honma, Microfilm of the specification and drawings annexed to the request of Japanese Utility Model Application No. 49-050413 (Laid-open No. 05-140854), Nov. 20, 1975.

(Continued)

*Primary Examiner* — Anthony Stashick
*Assistant Examiner* — James N Smalley
(74) *Attorney, Agent, or Firm* — Knobbe Martens Olson & Bear LLP

(57) ABSTRACT

Provided are a cap capable of being easily and reliably opened and unsealed not limited in design even if an inner cap with a small diameter is used for the cap, producing no refuse after the unsealing, and not unnecessarily large in size, and a container with the cap. When an over cap (3) is rotated in the opening direction, a pair of screw threads (10*a*, 10*b*) as opening means are advanced in the direction in which they are tightened together, and this cuts off a planned opening section (4) from the inner cap (2). Thus, the cap has a relatively simple structure and can be simply and reliably unsealed by small force. Also, the planned opening section (4) is integrated with the over cap (3) after unsealing the inner cap (2), so that no refuse is produced after the unsealing, eliminating the need to clear it away from a table.

8 Claims, 22 Drawing Sheets

U.S. PATENT DOCUMENTS

| | | | | |
|---|---|---|---|---|
| 4,402,417 | A | 9/1983 | Corrigan et al. | |
| 4,405,053 | A * | 9/1983 | Cherot | 215/48 |
| 4,434,904 | A | 3/1984 | D'Amico et al. | |
| 4,494,663 | A | 1/1985 | Bertaud et al. | |
| 4,662,529 | A | 5/1987 | Moore | |
| 4,747,501 | A * | 5/1988 | Greaves | 215/253 |
| 4,793,475 | A * | 12/1988 | Itzel | 206/221 |
| 4,874,101 | A | 10/1989 | Zalut | |
| 5,090,581 | A | 2/1992 | Rose et al. | |
| 5,295,518 | A | 3/1994 | Baker et al. | |
| 5,482,176 | A * | 1/1996 | Maietta et al. | 220/277 |
| 8,235,232 | B2 | 8/2012 | Isogai et al. | |
| 2002/0179605 | A1 * | 12/2002 | Miani et al. | 220/277 |
| 2004/0104193 | A1 * | 6/2004 | Yashima et al. | 215/344 |

OTHER PUBLICATIONS

International Preliminary Report on Patentability in Int'l. App. No. PCT/JP2007/059192 dated Apr. 28, 2006.

* cited by examiner

FD
803
SD

803
FD

SD
803

801
804d
803
820
11a
850a
11b
802
851
BR
850
809
804
802
BR
RT 801
804d
820
803
809
804
802
BR
850
RT 801
820
803
804
802
BR
RT 803
820
OP
804
802
BR
RT

NL
BR

CAP AND COVERED CONTAINER

CROSS-REFERENCE TO RELATED APPLICATIONS

This application is a divisional of U.S. application Ser. No. 12/298,751, filed Mar. 16, 2009, which is a national phase application of Application No. PCT/JP2007/059192, filed Apr. 27, 2007. PCT Application No. PCT/JP2007/059192 claims priority to JP Application No. 2006-126161, filed Apr. 28, 2006, and to JP Application No. 2006-327006, filed Dec. 4, 2006.

FIELD OF THE INVENTION

The present invention relates to a cap that is disposed on the mouth part of a bottle-shaped container, and a covered container comprising the cap.

BACKGROUND ART

As a cap on a bottle-shaped container, a combination of an inside plug for sealing and an overcap, which is an upper closure, is generally known (for example, refer to Japanese Patent Application Laid-open No. H8-58816). With the kind of cap, opening or unsealing is carried out by pulling a pull-ring attached to the inside plug diagonally in the opening direction after opening the overcap.

Further, a bottle cap, which has a material storage part for storing a powder or other such material, and which releases the material inside the bottle by causing the bottom lid of the raw material storage part to drop out due to the opening operation, is known (Japanese Patent Application Laid-open No. 2005-88997).

DISCLOSURE OF THE INVENTION

Problem to be Solved

However, with regard to the former cap, the manner in which the pull-ring is pulled can differ greatly by user, the consumer, and there is a likelihood of the pull-ring being torn off at a weld or other such easy-to-tear part at the time of opening or unsealing, making opening impossible.

Further, for example, when the score part is made thick to prevent pinholes in the score part, the force needed for opening increases, making opening difficult for children, the elderly and other users. Further, when the size of the pull-ring is made large enough for various users' fingers to fit thereinto, the pull-ring becomes unsuitable for a small diameter inside plug, thereby restricting the overall design of the cap. Furthermore, the pull-ring that remains after opening is normally an unsightly unwanted object that has to be cleaned off the table.

Further, as for the latter bottle cap, when the material need not or no longer needs to be released inside the bottle upon opening, the material storage part makes the bottle cap longer that necessary. Also, since the bottom lid always drops down inside the bottle, users are often put off by the fact that the bottom lid remains in the bottle. Further, the entire bottom lid has to be sterilized beforehand for the sake of hygiene.

Accordingly, an object of the present invention is to provide a cap and a covered container that makes use thereof, which make it possible to easily and reliably carry out opening or unsealing due to the rotation operation of the upper closure or overcap, and which reduce design restrictions even when the inside plug has a small diameter. Also, another object of the present invention is to provide a cap, which does not generate rubbish subsequent to unsealing, and which is not larger than necessary.

Means for Solving the Problem

In order to solve for the above-mentioned problems, a first cap related to the present invention includes (a) an inside plug, which, together with a main body of the container, forms an airtight space for enclosing the contents, and which has a separating part for forming an aperture part in the airtight space; and (b) an upper closure having a screwing part that enables attachment and detachment to and from the container main body by a rotation operation, and holding means, which makes enables to form the aperture part by separating the separating part from the above-mentioned inside plug by the rotation operation of the screwing part, and to engage with the separating part when the separating part is separated.

In the above-mentioned cap, since the inside plug and upper closure are attachable/detachable to/from another one in accordance with the rotation operation of the screwing part, and it is possible to form an aperture part by separating the separating part from the inside plug in accordance with this rotation operation, an unsealing operation can be carried out relatively easily and reliably. Further, since a pull-ring is not used at the time of unsealing, a situation in which the pull-ring tears and unsealing becomes impossible does not occur. Further, since there is no need to ensure a finger-inserting size as when a pull-ring is used, design is not restricted even when the inside plug has a small diameter. Furthermore, since the separating part, which is separated at the time of unsealing, is held by the upper closure, the separating part does not drop into the inside of the container main body subsequent to unsealing, and moreover, there is no need to dispose of the separating part.

Further, as another aspect of the present invention, the separating part engages with holding means at the time of the unsealing operation for forming the aperture part. In this case, since there is a mechanical relationship between the separating part and holding means at the time of the unsealing operation for forming the aperture part, for example, there is no need to weld the separating part and holding means beforehand in order to form the aperture part, making it possible to simplify the cap manufacturing process.

Further, as another aspect of the present invention, holding means forms the aperture part by separating the separating part from the inside plug due to the rotation operation of the screwing part, and also engages with the separating part at the time the separating part is separated. In this case, the separating part is separated from the inside plug due to the rotation operation of the screwing part, and the aperture part is formed, and, in addition, the upper closure holding means can hold the separating part.

Further, as another aspect of the present invention, the inside plug has in a center thereof an upper opening, which is blocked by the separating part, and has a main body part, which is contiguously connected to the separating part at this upper opening, and also engages with the container main body at the peripheral border, the main body part has a main body part cylinder that forms the upper opening, and the separating part has a separating part cylinder that is offset to either one of the inside diameter or the outside diameter relative to the main body part cylinder. In this case, after separating the separating part from the main body part at the initial opening, the separating part cylinder and the main body part cylinder overlappingly fit together when the upper closure is once again screwed into the main body part, thereby achieving liquid-tightness between the separating part and the main body part. That is, it is possible to prevent fluid leaks when re-closing the upper closure subsequent to opening.

Further, as yet another aspect of the present invention, the separating part has a flange in the upper part, and holding means has a protruding part, which extends downwardly from the bottom surface of the upper end wall of the upper closure, and a claw, which is formed on this protruding part, and which is capable of engaging with the flange. In this case, the separating part is easily and reliably held by the upper closure.

Further, as yet another aspect of the present invention, the upper closure has a mounting part that engages with the inside plug, and an opening-and-closing lid, which is connected to the mounting part via a hinging part, and, in addition, which is able to maintain a closed state, in which the aperture part is covered subsequent to unsealing, and an open state, in which the aperture part is open. In this case, subsequent to unsealing the inside plug, a one-touch opening-and-closing operation that opens and closes the cap can be carried out simply using the opening-and-closing lid.

Further, as yet another aspect of the present invention, the opening-and-closing lid has locking means for suppressing a lid-opening operation. In this case, since a lid-opening operation resulting from a malfunction or vandalism is not possible prior to unsealing, the reliability of the cap's seal can be enhanced.

Further, as yet another aspect of the present invention, the present invention also has push-in means for forming the aperture part by carrying out positioning in accordance with a rotation operation of the screwing part, making upper closure push-in possible in accordance with the positioning, and carrying out this push-in. In this case, it is possible to relatively easily and reliably form the aperture part in accordance with the rotation operation and push-in operation, while preventing the inadvertent unsealing of the inside plug.

Further, as yet another aspect of the present invention; the separating part is an intended aperture part, which is integrally formed with the main body part, and the holding means includes a second threaded member, which relatively displaces the separating part relative to the external portion of this separating part by screwing together with a first threaded member, which is disposed in the separating part. In this case, the separating part is severed off by the second threaded member, which is the upper closure holding means, being screwed together with the first threaded member, which is disposed in the separating part.

A second cap related to the present invention includes (a) an inside plug, which, together with the container main body, forms an airtight space for enclosing the contents, and which has a separating part for forming an aperture part in the airtight space; and (b) an upper closure having a screwing part that enables attachment and detachment to and from the container main body by a rotation operation, and opening means that forms an aperture part by separating the separating part from the inside plug due to the rotation operation of the screwing part.

In the above-mentioned cap, since the inside plug and the upper closure can be attached/detached to/from another one in accordance with the rotation operation of the screwing part, and the aperture part is formed, for example, by severing so as to separate the separating part from the inside plug due to this rotation operation, it is possible to carry out opening (that is, the unsealing of the inside plug) relatively easily and reliably. Further, since a pull-ring is not used at the time of unsealing, a situation in which the pull-ring tears and unsealing becomes impossible does not occur. Further, since there is no need to ensure a finger-inserting size as when a pull-ring is used, design is not restricted even when the inside plug has a small diameter.

Further, as a specific aspect of the present invention, the separating part is an intended aperture part, which is to be severed from the inside plug. In this case, the separating part is severed from the inside plug as an intended aperture part that is integrally formed with the main body part.

Further, as a specific aspect of the present invention, opening means includes a second threaded member, which relatively displaces the intended aperture part relative to the external portion of this intended aperture part by screwing together with a first threaded member disposed in the intended aperture part. In this case, since the intended aperture part is separated by the second threaded member, which is the upper closure holding means, being screwed together with the first threaded member, which is disposed in the intended aperture part, a member such as a bottom lid is not dropped into and left behind inside the container main body, and, in addition, no rubbish is produced subsequent to unsealing.

Further, as another aspect of the present invention, the second threaded member is the male thread while the screwing part is the female thread, and, in addition, is in an opposite direction relationship with the screwing part, and the rotation operation for operating opening means is rotation in the direction that opens the upper closure. In this case, while rotation in the direction that opens the upper closure rotates in the direction which loosens the screwing part, the first and second threaded members screw together in the tightening direction by being screwed together with one another. Consequently, the intended aperture part is pulled upwardly, the aperture part is formed, and the inside plug, as an inside plug, is either unsealed or opened.

Further, as yet another aspect of the present invention, the second threaded member is the male thread while the screwing part is the female thread, and, in addition, is in a forward direction relationship with the screwing part, and the rotation operation for operating opening means is rotation in the direction that closes the upper closure. In this case, the screwing part and the first and second threaded members are all screwed in the tightening direction by being respectively screwed together with one another. Consequently, the intended aperture part is either pulled upwardly or pushed downwardly, and the inside plug, as an inside plug, is either unsealed or opened.

Further, as yet another aspect of the present invention, the inside plug is formed of a resin material, and a thin-walled score is formed between the intended aperture part and the external portion. In this case, the intended aperture part is easily separated along the thin-walled score when forming the aperture part for unsealing the inside plug.

Further, as yet another aspect of the present invention, opening means includes a cutting member, which moves together with the screwing part, and which causes the external portion to relatively separate from the intended aperture part. In this case, using the cutting member makes it possible to either support the separation of the external portion and the intended aperture part, or to carry out this separation independently. Furthermore, it is possible to dispose a protruding seal that sticks fast to the interior surface of the inside plug main body subsequent to unsealing the upper closure.

Further, as yet another aspect of the present invention, the cutting member has a blade-edged portion, which annularly protrudes downwardly from the bottom surface of the apex of the upper closure, and which has a cross-section that is acutely angled at a lower end thereof. In this case, it is possible to match the blade edged portion of the cutting member to the shape of the aperture part, making it possible to more reliably separate the intended aperture part and carry out unsealing.

Further, as yet another aspect of the present invention, the upper closure includes a stopper that prevents the upper closure from being screwed onto the container main body by a rotation operation. In this case, it is possible to prevent the inside plug from being unsealed by mistake when the present invention is not being used.

Further, as yet another aspect of the present invention, the separating part is an internal sealing plug that can block the aperture part subsequent to unsealing. In this case, the separating part functions as an internal sealing plug subsequent to unsealing, thereby configuring an airtight space, which makes it hard for liquid to leak out subsequent to unsealing, and which maintains a hygienic state.

Further, as yet another aspect of the present invention, the upper closure has holding means, which engages with the separating part when this separating part is separated due to the rotation operation of the screwing part. In this case, since the separating part, which was separated at the time of unsealing, is held by the upper closure, the separating part does not drop down inside the container main body subsequent to unsealing the inside plug, and, moreover, there is no need to dispose of the separating part.

Further, as yet another aspect of the present invention, the separating part engages with holding means at the time of the unsealing operation for forming the aperture part. In this case, since there is a mechanical relationship between the separating part and holding means at the unsealing of the inside plug, that is, at the time of the unsealing operation for forming the aperture part, for example, there is no need to weld the separating part and holding means beforehand in order to form the aperture part.

Further, as yet another aspect of the present invention, the upper closure has a mounting part that engages with either the periphery of the inside plug or the container main body, and an opening-and-closing lid, which is connected to the mounting part via a hinging part, and, in addition, which is able to maintain a closed state, in which the aperture part is covered subsequent to opening, and an open state, in which the aperture part is open. In this case, subsequent to unsealing the inside plug, a one-touch opening-and-closing operation that opens and closes the cap can be carried out simply using the opening-and-closing lid.

Further, as yet another aspect of the present invention, the inside plug has in a center thereof an upper opening, which is blocked by the separating part, and has a main body part, which is contiguously connected to the separating part at this upper opening, and which also engages with the container main body at the peripheral border, the main body part has a main body part cylinder that forms the upper opening, and the separating part has a separating part cylinder that is offsets to either one of the inside diameter or the outside diameter relative to the main body part cylinder. In this case, after separating the separating part from the main body part at the initial opening, the separating part cylinder and the main body part cylinder overlappingly fit together when the upper closure is once again screwed onto the container main body, thereby achieving liquid-tightness between the separating part and the main body part even subsequent to unsealing. That is, it is possible to prevent fluid leakage when re-closing the upper closure subsequent to opening.

Further, as yet another aspect of the present invention, the inside plug forms an airtight space by integrally molding the separating part, which is to be severed, and the main body part. In this case, since the unsealing of the inside plug is carried out by severing the separating part from the integrally molded separating part and main body part, it is possible to maintain a hygienic state inside the airtight space until immediately prior to unsealing.

Further, as yet another aspect of the present invention, the separating part has a flange in the upper part, and holding means has a protruding part, which extends downwardly from the bottom surface of the upper end wall of the upper closure, and a claw, which is formed on this protruding part, and which is capable of engaging with the flange. In this case, the separating part is easily and reliably held by the upper closure.

A third cap related to the present invention includes (a) an inside plug, which, together with the container main body, forms an airtight space for enclosing the contents, and which has a separating part for forming an aperture part in the airtight space; and an upper closure having (b1) a screwing part that enables attachment and detachment to and from the container main body by a rotation operation; (b2) holding means, which forms an aperture part by separating the separating part from the inside plug by the rotation operation of the screwing part, and which engages with the separating part at the time the separating part is separated; (b3) a mounting part, which is severed from the inside plug due to the rotation operation of the screwing part, and, in addition, which is able to engage with the container main body via the screwing part; and (b4) an opening-and-closing lid, which is connected to the mounting part by way of a hinging part, and, in addition, which is able to maintain a closed state, in which the aperture part is covered subsequent to unsealing, and an open state, in which the aperture part is open.

In the cap described hereinabove, since the inside plug and the upper closure form an aperture part in accordance with the rotation operation of the screwing part by making it possible to separate the intended aperture part from the inside plug due to the rotation operation, an opening operation can be carried out relatively easily and reliably. Further, since a pull-ring is not used at the time of unsealing, a situation in which the pull-ring tears and unsealing becomes impossible does not occur. Further, since there is no need to ensure a finger-inserting size as when a pull-ring is used, design is not restricted even when the inside plug has a small diameter. Furthermore, since the separating part, which is separated at the time of unsealing, is held by the upper closure, the separating part does not drop into the inside of the container main body subsequent to unsealing, and moreover, there is no need to dispose of the separating part. In addition to the above, in the cap described hereinabove, since an opening-and-closing lid is connected to a mounting part by way of a hinging part, and the mounting part can be severed from the inside plug due to the rotation operation of the screwing part, and, in addition, can engage with the container main body via the screwing part, it is possible for the elements that make up the cap to be configured integrally. Further, subsequent to unsealing the inside plug, a one-touch opening-and-closing operation that opens and closes the cap can be carried out simply using the opening-and-closing lid.

Further, as another aspect of the present invention, the separating part engages with holding means at the time of the unsealing operation for forming the aperture part. In this case, since there is a mechanical relationship between the separating part and holding means at the time of the opening operation for forming the aperture part, for example, there is no need to weld the separating part and holding means beforehand in order to form the aperture part.

Further, as yet another aspect of the present invention, the inside plug and the upper closure are integrally molded as one article. In this case, it is possible to make the respective components integral, and to integrally mold the entire cap as a single article.

Further, as yet another aspect of the present invention, the opening-and-closing lid has locking means for suppressing a lid-opening operation. In this case, since a lid-opening operation cannot be carried out as the result of a malfunction or vandalism prior to unsealing, the reliability of the cap's seal can be enhanced.

Further, as yet another aspect of the present invention, the screwing part has rotation suppressing mechanism, which allows a rotation operation in only one direction, and suppresses rotation in the other direction. In this case, since the rotation suppressing mechanism is able to make the direction of rotation in a rotation operation one direction only, malfunctions can be prevented.

Further, as yet another aspect of the present invention, the screwing part makes the direction of the rotation operation for forming the aperture part the counterclockwise direction. In this case, the initial direction of rotation for unsealing can be made the counterclockwise direction, making it possible to prevent malfunctions.

Further, in order to solve the above-mentioned problems, a covered container related to the present invention includes (a) a bottle, which constitutes the container main body, and which stores a liquid that is the contents; and (b) any of the above-described caps, which is disposed on the mouth part of the bottle.

In the covered container described hereinabove, since any of the above-described caps is used, the unsealing of the aperture, that is, the inside plug, can be done easily and reliably due to a rotation operation of the overcap, and, further, design is not restricted even when the inside plug has a small diameter, and, furthermore, there is no rubbish left on the table subsequent to unsealing.

BEST MODE FOR CARRYING OUT THE INVENTION

First Embodiment

Figure 1:
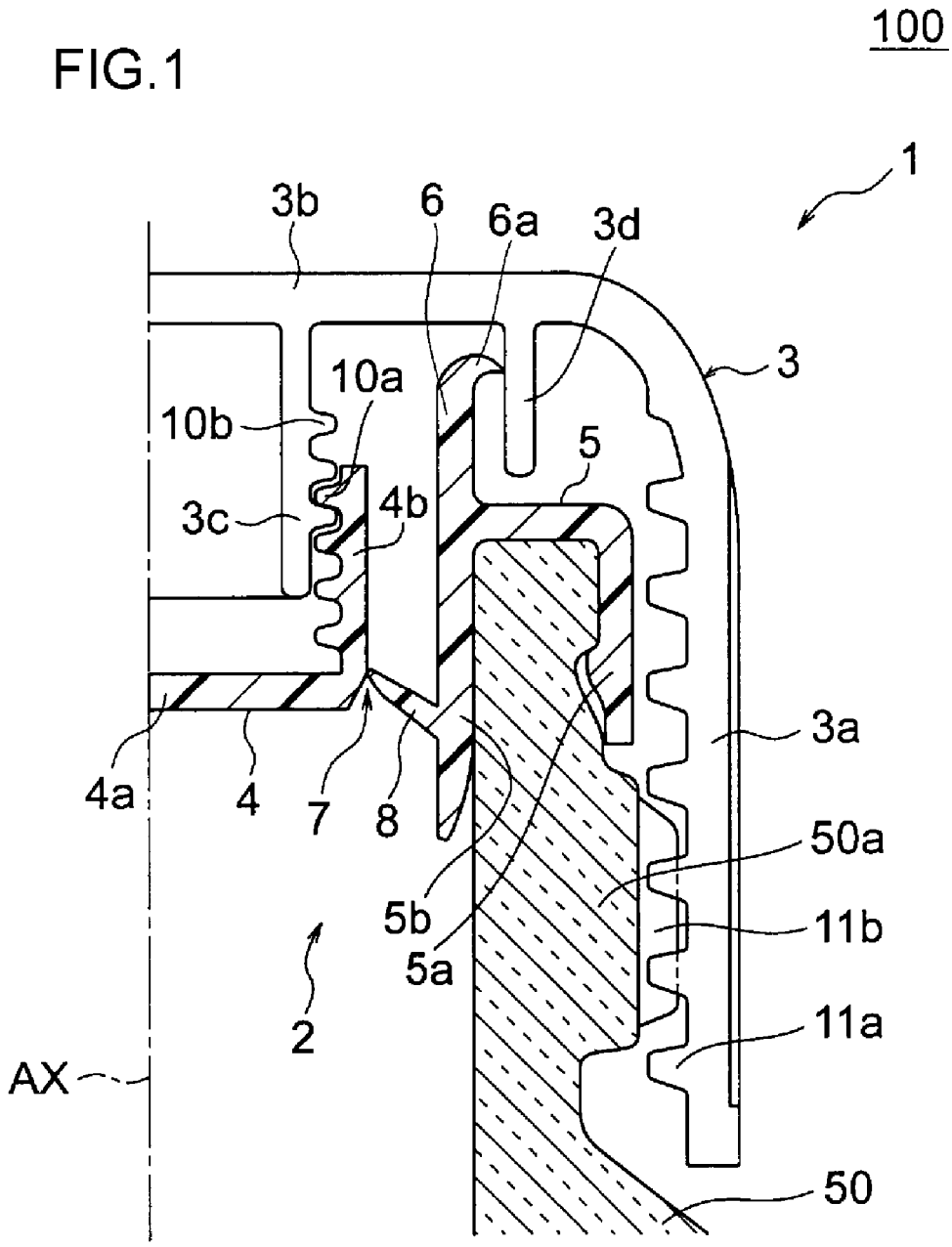
FIG. 1 is a cross-sectional view for illustrating a cap related to a first embodiment.

FIG. 1 is a partial cross-sectional diagram of a covered container for illustrating a tap composite cap related to a first embodiment.

A cap 1 related to this embodiment is molded using resin, is attached to the mouth part 50*a* of a container main body 50, which is a bottle, and comprises an inside plug 2, which is the closure main body, and an overcap 3, which is the upper closure. The cap 1 and the container main body 50 constitute a covered container 100 for storing and preserving a liquid. Furthermore, for the sake of simplicity, only the right half of the cap 1 is shown in the figure, but a left half, which sandwiches the center axis AX, has the same structure as the right side.

The inside plug 2 is an integrally molded component made of resin, and comprises a predetermined aperture part or an intended aperture part 4; a fitting part 5; and a pour-out cylinder part 6. The fitting part 5 and pour-out cylinder part 6 here configure the main body part of the inside plug 2. The inside plug 2, by virtue of the tap, forms an airtight space together with the container main body 50 for either air-tightly or liquid-tightly enclosing the contents. Within the inside plug 2, the intended aperture part 4 is also a separating part that has a cylindrical exterior having a bottom surface, and at the time the inside plug 2 is unsealed, that is, at the time of initial opening, the inside plug 2 is torn along a score 7, and the aperture part is formed by the intended aperture part 4 being severed from a horizontal wall 8 formed on the inner circumference of the fitting part 5, leaving the horizontal wall 8 behind. Further, a female thread 10*a* for screwing together with the overcap 3 is formed on the inner surface of the side part 4*b* of the intended aperture part 4 (will be explained in detail hereinbelow). The fitting part 5 is a fitting member for carrying out tapping by fitting the inside plug 2 to the mouth part 50*a* of the container main body 50. The fitting part 5 is configured having an external cylinder part 5*a*, which is adhered and fastened to the peripheral wall of the mouth part 50*a* of the container main body 50; and an internal cylinder part 5*b*, which is adhered and fastened to the inside wall of the mouth part 50*a*. The pour-out cylinder part 6 is cylindrical as a whole, but has a lip 6*a* at the upper end part the diameter of which increases upwardly, improving drainability when pouring out a liquid from inside the container main body 50.

The overcap 3 is an integrally molded component made from resin, and comprises a sidewall 3*a*; an upper end wall 3*b*; a connecting part 3*c*; and a sealing part 3*d*. The sidewall 3*a* and upper end wall 3*b* form a dome-shaped exterior, and protect the inside plug 2 from the outside environment, such as dust and moisture. The connecting part 3*c* serves as holding means for holding the intended aperture part 4, which is separated from the inside plug 2 subsequent to unsealing the inside plug 2, inside the dome configured by the sidewall 3*a* and upper end wall 3*b*. The inner wall of the sealing part 3*d* adheres to the lip 6*a* of the upper end part of the pour-out cylinder part 6. Consequently, the upper end part of the pour-out cylinder part 6 can be maintained liquid-tight, and can prevent the contents inside the container main body 50 from leaking to the outside in a state in which the overcap 3 is attached, making possible opening-and-closing operations subsequent to the inner seal 2 being unsealed.

The female thread 11*a* and male thread 10*b* are respectively formed in the overcap 3 on the inner side of the sidewall 3*a* and on the outer side of the connecting part 3*c*. The female thread 11*a* formed in the sidewall 3*a* is a screwing part that constitutes a pair with the male thread 11*b* comprised on the side of the mouth part 50*a* of the container main body 50. The overcap 3 is attachably/detachably fastened to the mouth part 50*a* of the container main body 50 by screwing together the female thread 11*a* and the male thread 11*b*. That is, the overcap 3 can be attached/detached to/from the container main body 50 by a forward or reverse rotation operation. Meanwhile, the male thread 10*b* formed on the connecting part 3*c* is a second threaded member that constitutes a pair with the female thread 10*a*, which is a first threaded member disposed on the intended aperture part 4. The male thread 10*b* screws together with the female thread 10*a* due to a rotation operation in the opening direction, that is, in the counterclockwise direction of the overcap 3, and is opening means which tears the intended aperture part 4 from the inside plug 2 by pulling the intended aperture part 4 so as to pull it off, thereby opening or unsealing the cap 1. This opening will be explained in greater detail hereinbelow.

In this embodiment, in particular, a pair of threads 10*a*, 10*b*, which is the one screwing part, and the pair of threads 11*a*, 11*b*, which is the other screwing part, constitute a reverse-direction relationship (i.e. opposite direction relationship) with one another. That is, for example, when male thread 11*b* is a right-handed thread, male thread 10*b* by contrast is a left-handed thread. Consequently, when the overcap 3 is rotated in the opening direction (counterclockwise), the pair of threads 11*a*, 11*b*, which are right-handed threads, rotate in the loosening direction, but the pair of threads 10*a*, 10*b*, which are left-handed threads, by contrast rotate in the tightening direction. In accordance with this relationship, the female thread 10*a*, that is, the intended aperture part 4 moves toward the top relative to the sheet of paper on which FIG. 1 is drawn to a greater degree than the movement of the overcap 3. That is, the intended aperture part 4 is rapidly pulled upwardly by the rotation operation of the overcap 3 in the opening direction. The intended aperture part 4 is held by the upper closure 3 subsequent unsealing.

Figure 2:
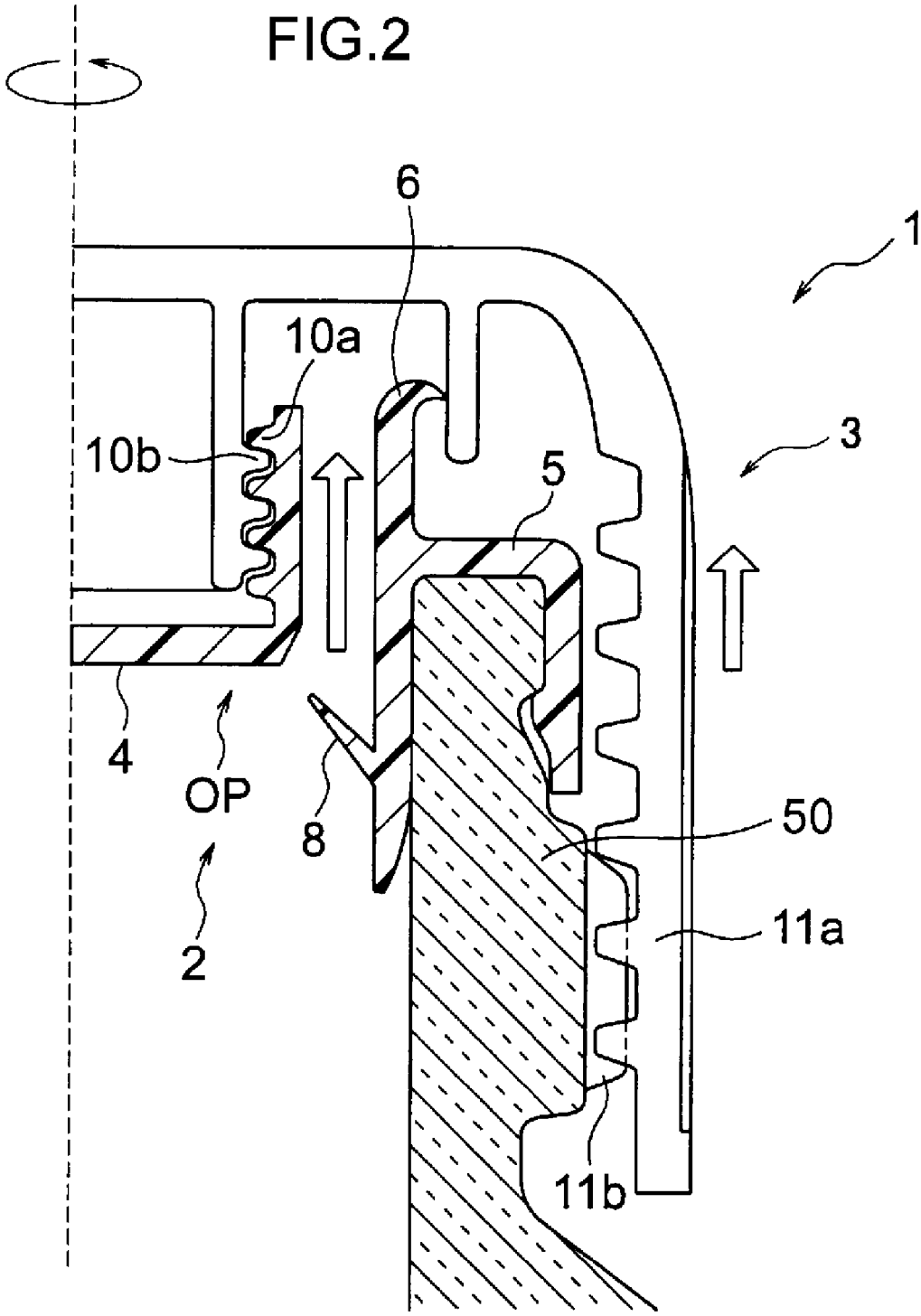
FIG. 2 is a cross-sectional view showing an open state according to the cap related to the first embodiment.

FIG. 2 is a cross-sectional view showing a state in which the cap 1 related to this embodiment has been opened, that is, unsealed. As described above, in accordance with a rotation operation of the overcap 3 in the opening direction, the pair of threads 11*a*, 11*b* rotate in the loosening direction in accordance with being screwed together, and the pair of threads 10*a*, 10*b* are rotated, that is, screwed in the tightening direction in accordance with being screwed together. Consequently, the intended aperture part 4 is rapidly pulled upwardly as the overcap 3 steadily rises, and the intended aperture part 4 is torn away from the pour-out cylinder part 6 of the inside plug 2 along the score 7, which constitutes a thin-walled part as shown in FIG. 1 (refer to FIG. 2). The inside plug 2 is unsealed by the aperture part OP formed in the place where the intended aperture part 4 was torn off.

In this case, using a rotation operation of a large-diameter overcap 3 produces a large moment even with a relatively small force, making it possible to achieve sufficient force to pull and tear off the intended aperture part 4 by using the pair of threads 10*a*, 10*b*.

Figure 3B:
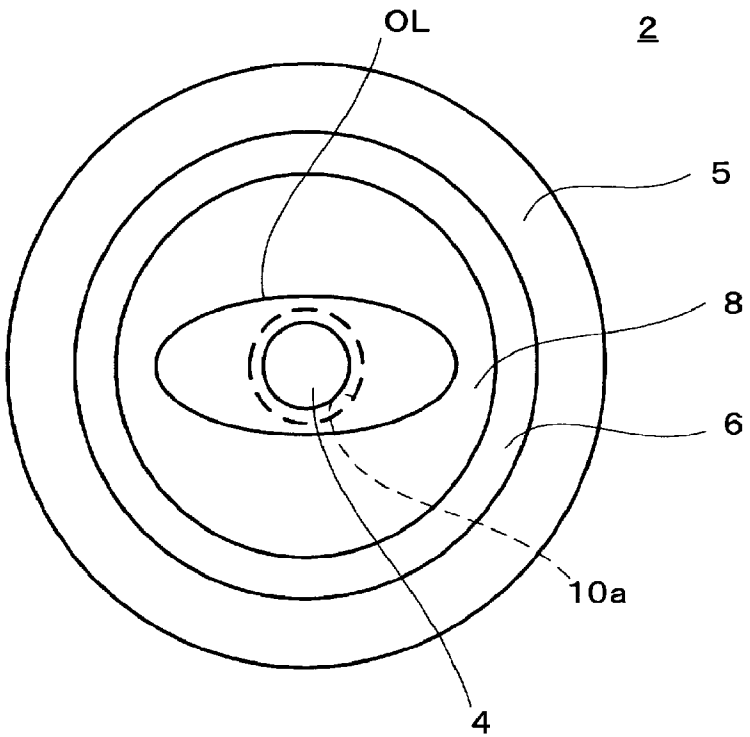
FIGS. 3*a* and 3*b* are diagrams showing the aperture shape of an inside plug related to the first embodiment.
Figure 3A:
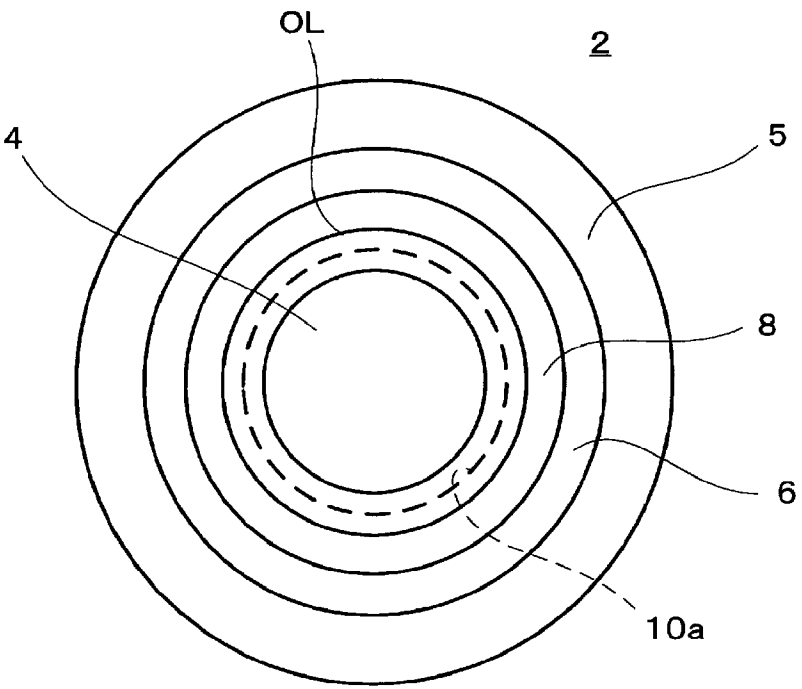

FIG. 3*a* is a planar view of the inside plug 2 as seen from above. The outline OL is formed here by a score 7, which is the thin-walled part of FIG. 1. That is, the intended aperture part 4 of FIG. 1, that is, the shape of the aperture part OP of FIG. 2 corresponds to the area surrounded by the outline OL, and this area is the shape of the aperture of the inside plug 2 related to this embodiment. Furthermore, in FIG. 3*a*, the shape of the outline OL is a circle shape, but the outline OL shape, that is, the aperture shape is not limited to this, and can be arbitrarily changed as long as it is possible to form the structure of the pair of threads 10*a*, 10*b* shown in FIG. 1 and so forth in the area inside the outline OL. For example, the shape of the outline OL can also be made into an elliptical as in FIG. 3*b*. At this time, the structure of the threads 10*a*, 10*b* can be disposed inside of the outline OL the same as in FIG. 3*a*.

As described above, in this embodiment, since the intended aperture part 40 is torn away from the inside plug 2 by the pair of threads 10*a*, 10*b*, which serve as opening means, being screwed in the tightening direction due to a rotation operation of the overcap 3 in the opening direction, the unsealing of the cap 1, that is, the unsealing of the inside plug 2 due to a rotation operation of the overcap 3, which is the upper closure, can be done with a relatively simple structure, and the separated intended aperture part 4 is held by the upper closure 3 by virtue of the pair of threads 10*a*, 10*b* being screwed together.

Further, in this case, a situation that can occur when a pull-ring is used for unsealing, that is, a situation in which the pull-ring tears at the weld portion making opening impossible, does not occur. Further, since the unsealing of the inside plug 2 is carried out by a rotation operation of the overcap 3, unsealing can be carried out easily and reliably using relatively little force. In addition, since a threaded structure (specifically, threads 10*a*, 10*b*) can be formed in the area occupied by the aperture part OP, for example, there is no need to ensure a size big enough for a finger to be inserted into, making it possible to use a small diameter inside plug, and, further, making it possible to avoid restrictions on the design of the cap 1. Furthermore, since the intended aperture part 4 becomes integrated with the overcap 3 subsequent to the unsealing of the inside plug 2, no rubbish is produced subsequent to unsealing, and, for example, there is no need to remove such rubbish from the table.

Furthermore, in this embodiment, the inside plug 2 is a tap composite cap, and is constituted by using a fitting part 5 together with the container main body 50 to enclose contents either air-tightly or liquid-tightly by virtue of a tap, but the present invention is not limited to a tap, and, for example, the storing of a liquid, which is the contents of the container main body 50, is also possible using a screw-type cap or weld sealing.

Figure 4:
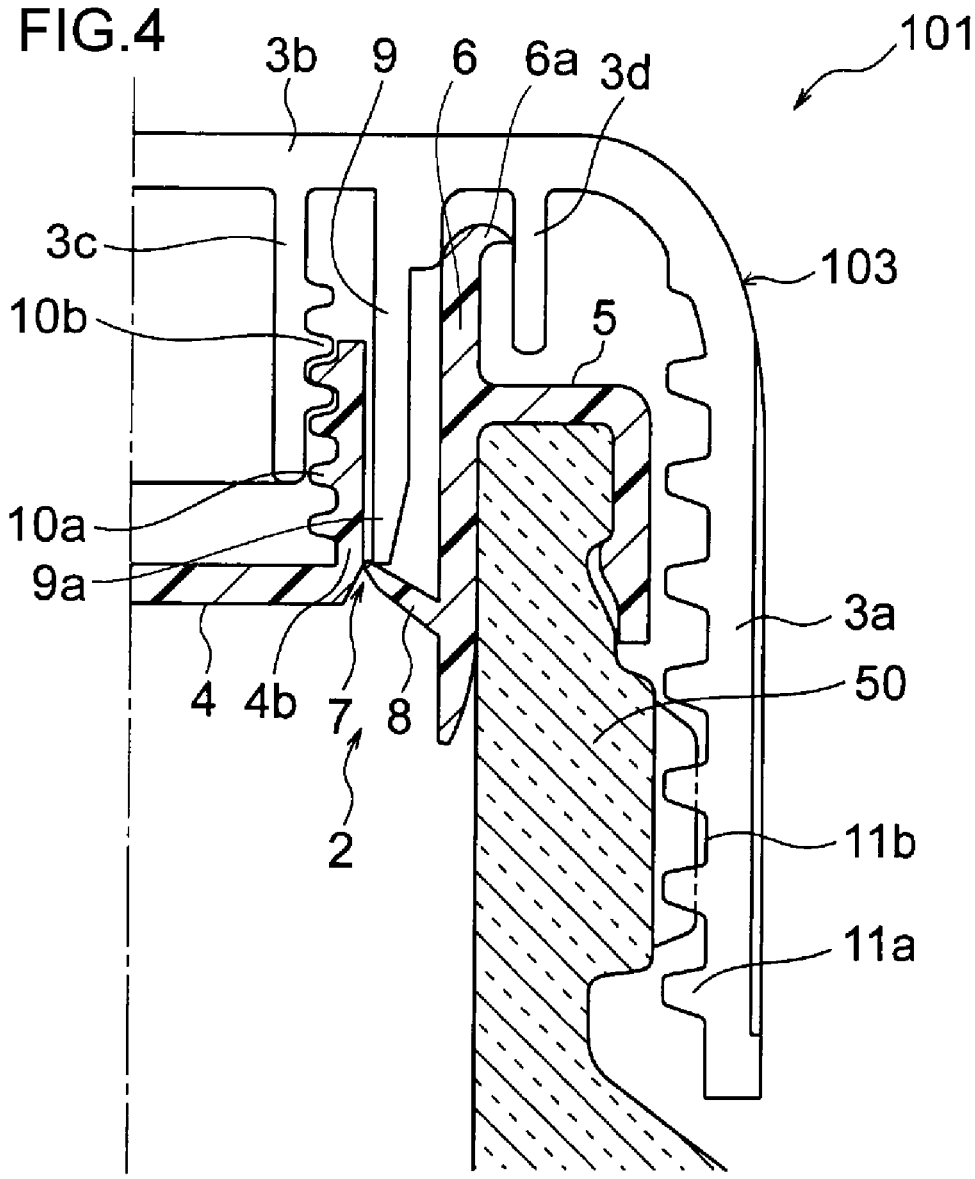
FIG. 4 is a cross-sectional view for illustrating a cap related to a variation of the first embodiment.

FIG. 4 is a cross-sectional view for illustrating a cap 101 related to a variation of this embodiment. The cap 101 of this variation is molded from resin, and the structures of the members having the same reference numerals as the reference numerals of the cap 1 shown in FIG. 1 are the same as those of the cap 1 shown in FIG. 1, and explanations of these members will be omitted.

In this variation, an overcap 103 has a sleeve 9, which is a cutting member that also serves as opening means. The sleeve 9, as shown in FIG. 4, is an annular protruding shape that hangs down from the bottom surface of the upper end wall 3*b* that forms the apex of the overcap 103, and the cross-section of the lower end part 9*a* thereof has an acutely angled blade-edged portion, and either makes touch-contact with or comes into close proximity to the score 7, which constitutes a thin-walled part.

Figure 5:
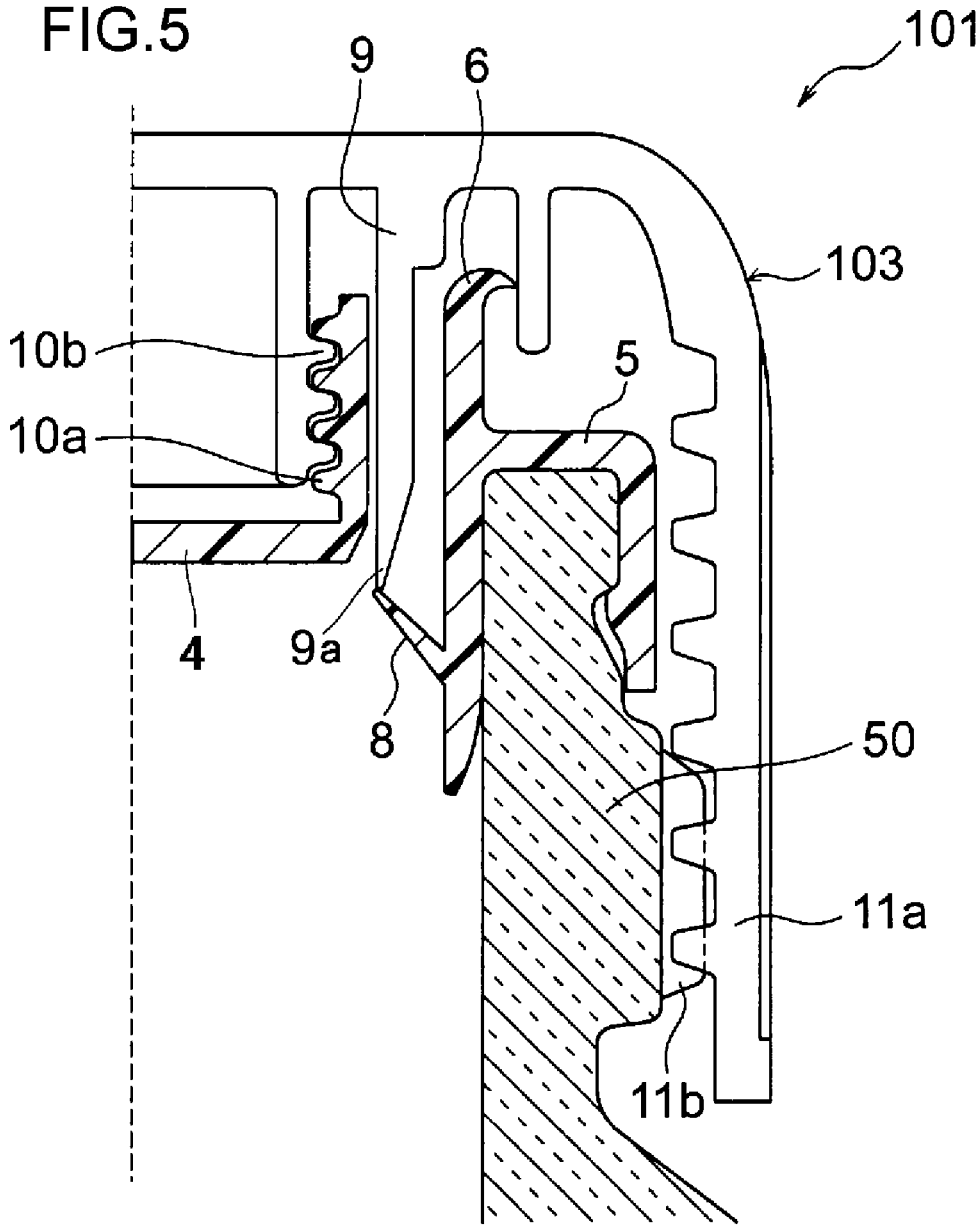
FIG. 5 is a cross-sectional view showing an open state according to the cap related to the variation of the first embodiment.

FIG. 5 is a cross-sectional view showing an open state according to the cap 1 related to this variation. In the case of this variation, at unsealing, the sleeve 9 moves upwardly together with a rotation operation in the opening direction of the overcap 103, that is, the counterclockwise direction, and this movement is smaller than the displacement of the intended aperture part 4. The result of this is that the sleeve 9 acts to separate the horizontal wall 8, which is the external portion of the score 7, to the lower side from the intended aperture part 4. Therefore, in the case of this variation, in addition to the action of the pair of threads 10*a*, 10*b* explained in the first embodiment, a force is applied to the score 7, which is the thin-walled part, in accordance with the action of the sleeve 9 in line with the rising of the female thread 10*a*. Consequently, the tearing off of the intended aperture part 4 can be carried out with greater reliability. Furthermore, in this variation, the sleeve 9 is an annular protruding shape, and, in addition, the cross-section of the lower end part 9*a* thereof is constituted having an acutely angled blade-edged portion, but the shape of the sleeve 9 is not limited thereto, and, for example, can also be either an annular or cylindrical protruding part, the lower end part 9*a* of which on-and-off periodically either makes touch-contact with or comes in close proximity to the score 7. Further, the cross-section of the lower end part 9*a*, for example, can also be serrated.

Furthermore, in the above-described embodiment, it is also possible to screw together the thread 10*a* disposed in the sidewall 4*b* of the intended aperture part 4 and the thread 10*b* disposed on the connecting part 3*c* of the overcap 3 beforehand prior to unsealing the inside plug 2, and it is also possible to commence screwing together the two threads 10*a*, 10*b* in accordance with the rotation of the overcap 3 at the time the inside plug 2 is unsealed.

Second Embodiment

The cap of a second embodiment is the type that unseals by screwing in. That is, in the first embodiment, as shown in FIG. 1 and so forth, the unsealing of the inside plug 2 is performed by screwing in the tightening direction in accordance with screwing the pair of threads 10*a*, 10*b* together with each other due to the rotation operation of the overcap 3 in the opening direction, thereby pulling the intended aperture part 4 upward, but in the second embodiment, by contrast, a case in which the unsealing of the inside plug 2 is carried out due to a rotation operation of the overcap in the closing direction will be explained.

Figure 6:
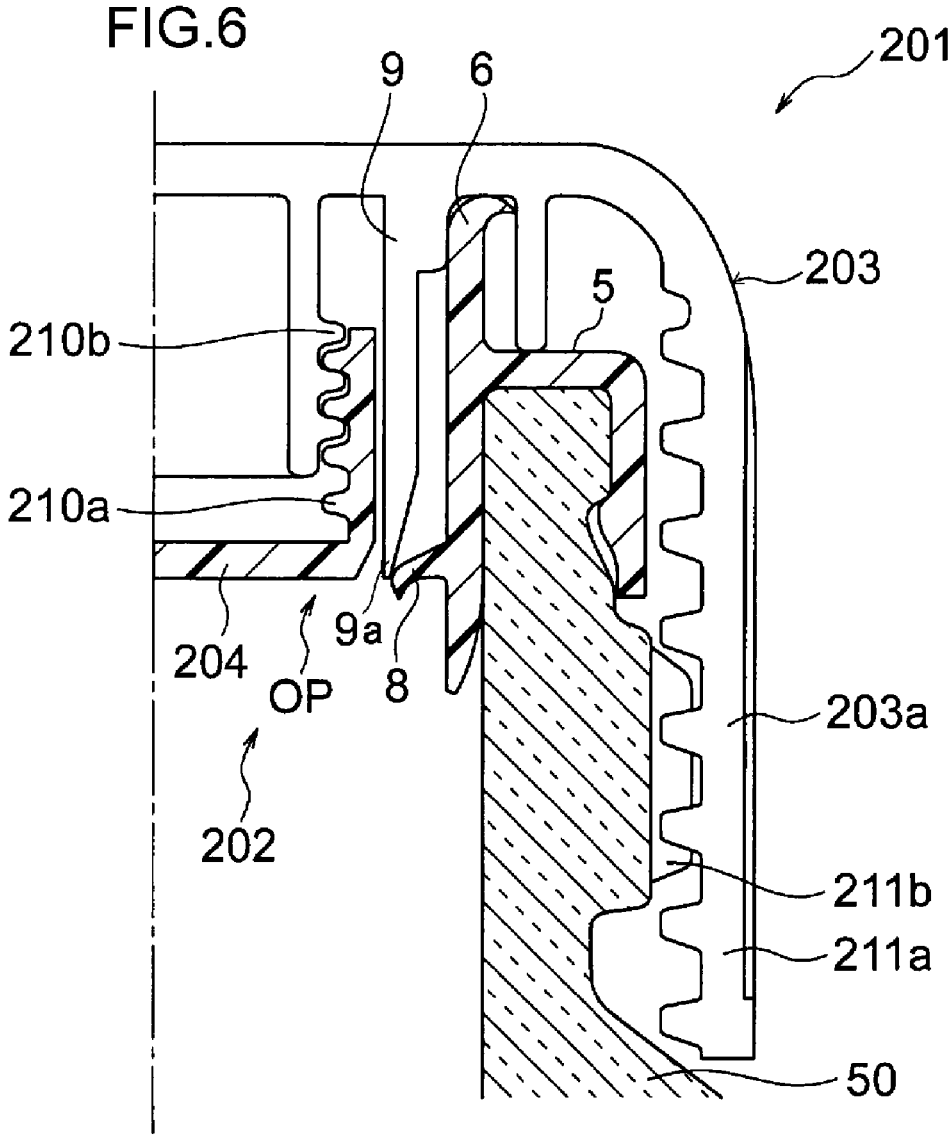
FIG. 6 is a cross-sectional view showing an open state according to a cap related to a second embodiment.

FIG. 6 is a cross-sectional view showing an open state according to a cap related to this embodiment. Furthermore, in the molded-resin cap 201 of this embodiment, since the structures of the members having the same reference numerals as the reference numerals in either FIG. 1 or FIG. 4 used in the explanations of the first embodiment and the variation thereof are the same, explanations of these members will be omitted. The points of difference with the first embodiment will mainly be explained below as the characteristic features of this embodiment.

In this embodiment, a pair of threads 210*a*, 210*b*, which is used as either opening means or separating means, and another pair of threads 211*a*, 211*b* have a mutual forward-direction relationship. That is, for example, when the male thread 211*b* is a right-handed thread, the male thread 210*b* is also a right-handed thread. Therefore, the pair of threads 210*a*, 210*b* and the pair of threads 211*a*, 211*b* are rotated, that is, screwed in the tightening direction in accordance with the screwing together of either pair as the result of a rotation operation in the closing direction of the overcap 203 (a clockwise rotation operation).

When pair of threads 210*a*, 210*b* and pair of threads 211*a*, 211*b* are in the relationship of this embodiment, the male thread 210*a*, that is, the intended aperture part 204 moves either upwardly or downwardly in accordance with the movement of the overcap 203. That is, the intended aperture part 204 is either pulled upwardly or pushed downwardly by a rotation operation in the closing direction of the overcap 203. At this time, the sleeve 9 also acts to cut the thin-walled part by pushing downwardly in line with the movement of the overcap 203. Consequently, the intended aperture part 204 is torn away from the inside plug 202 (see FIG. 6). The inside plug 202 is unsealed by an aperture part OP being formed at the place where the intended aperture part 204 has been torn away. Furthermore, FIG. 6 shows a case in which the intended aperture part 204 is pushed downwardly, but whether the movement of the intended aperture part 204 is upward or downward is determined by the magnitude correlation between the pitch of the screwing portion of the pair of threads 210*a*, 210*b* and the pitch of the screwing portion of the pair of threads 211*a*, 211*b*. Furthermore, the female thread 210*a*, that is, the intended aperture part 204 can be such that this part 204 moves neither upwardly nor downwardly at the time of the movement of the overcap 203. In this case, the pitches of the respective screwing portions mentioned above are equivalent to one another, and the thin-walled part is cut by the sleeve 9 pushing downwardly in line with the movement of the overcap 203.

Furthermore, in this embodiment, as described hereinabove, the action of the sleeve 9 unseals the inside plug 2, but the unsealing of the inside plug 2 can also be carried out by the either upward or downward movement of the pair of threads 210*a*, 210*b* alone. Further, for example, if the entire intended aperture part 204 can be disinfected and sterilized, and there are no problems from the standpoint of hygiene, the pair of threads 210*a*, 210*b* is not provided, and the unsealing of the inside plug 202 is carried out by the intended aperture part 204 being pushed and cut by the sleeve 9 alone, and the intended aperture part 204 dropping inside the container main body 50.

Figure 7:
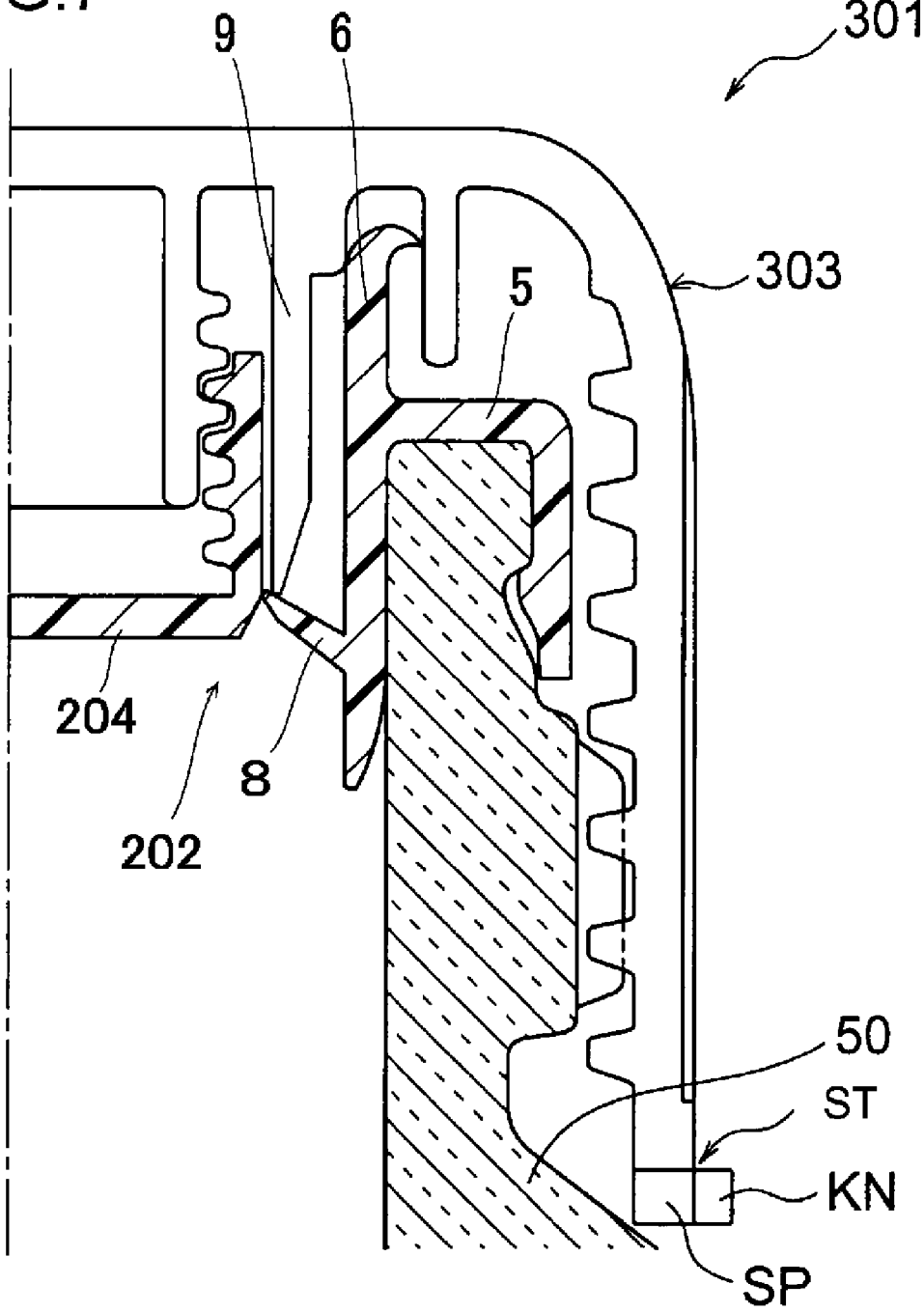
FIG. 7 is a cross-sectional view for illustrating a cap related to a variation of the second embodiment.

FIG. 7 is a cross-sectional view for illustrating a resin-molded cap 301 that is also provided with a stopper as a variation of this embodiment.

In this variation, as shown in FIG. 7, the overcap 303 also comprises a stopper SP. The stopper SP is an annular band disposed on the lower end part of the overcap 303. A split ST is disposed between the overcap 303 and the stopper SP, and the stopper SP can be torn away simply by pulling a knob KN. Further, the stopper SP is located in close proximity to the container main body 50 here. Consequently, since it is not possible to screw, that is, to rotate the overcap 303 in a clockwise direction onto the container main body 50 more than this without removing the stopper SP, it is possible to prevent a vendor or the like from mistakenly rotating the overcap 303 when not in use, thereby preventing the unsealing of the inside plug 202. Furthermore, the provision as a stopper SP of an element having a mechanism for stopping a rotation operation in the opening direction of the overcap can also be applied to the first embodiment.

Figure 8:
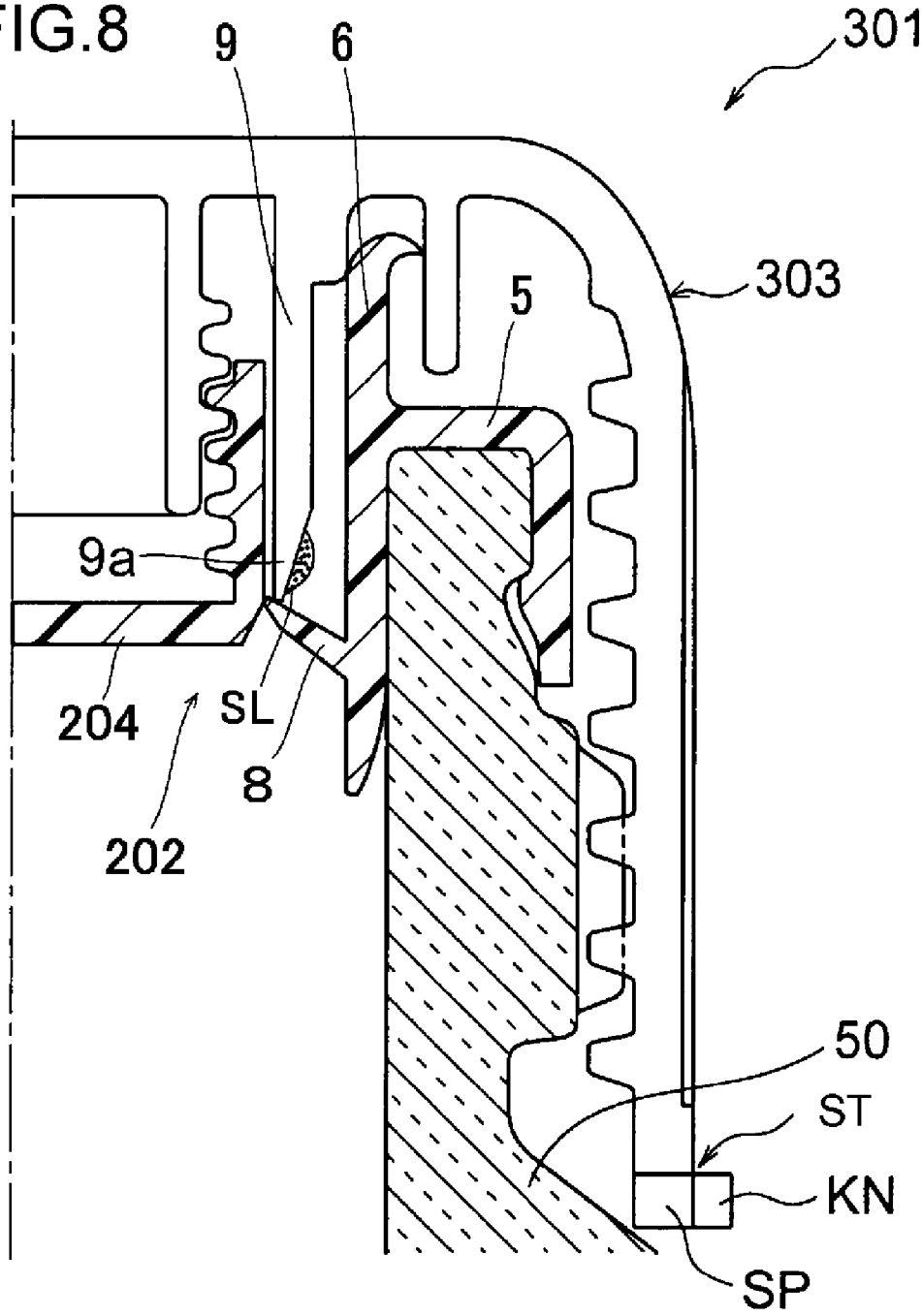
FIG. 8 is a cross-sectional view for illustrating a cap related to another variation of the second embodiment.

FIG. 8 is a cross-sectional view for illustrating a cap 301 that is provided with a seal for reinforcing sealing at recapping time as another variation of this embodiment.

In this variation, as shown in the figure, a seal SL, which is an annular low protrusion, is disposed on the periphery of the lower end part 9*a* of the sleeve 9 of the overcap 303. In the case of this variation, when screwing the overcap 303 onto the container main body 50 once again subsequent to the overcap 303 first being unsealed in accordance with removing the stopper SP, the seal SL can enhance sealability by adhering firmly to the severed edge of the horizontal wall 8, making it easier to get a sense for when recapping is complete. Furthermore, a seal SL such as that shown in FIG. 8 can also be disposed on the sleeves 9 of the overcaps 103, 203 shown in FIGS. 4 and 5.

Figure 9:
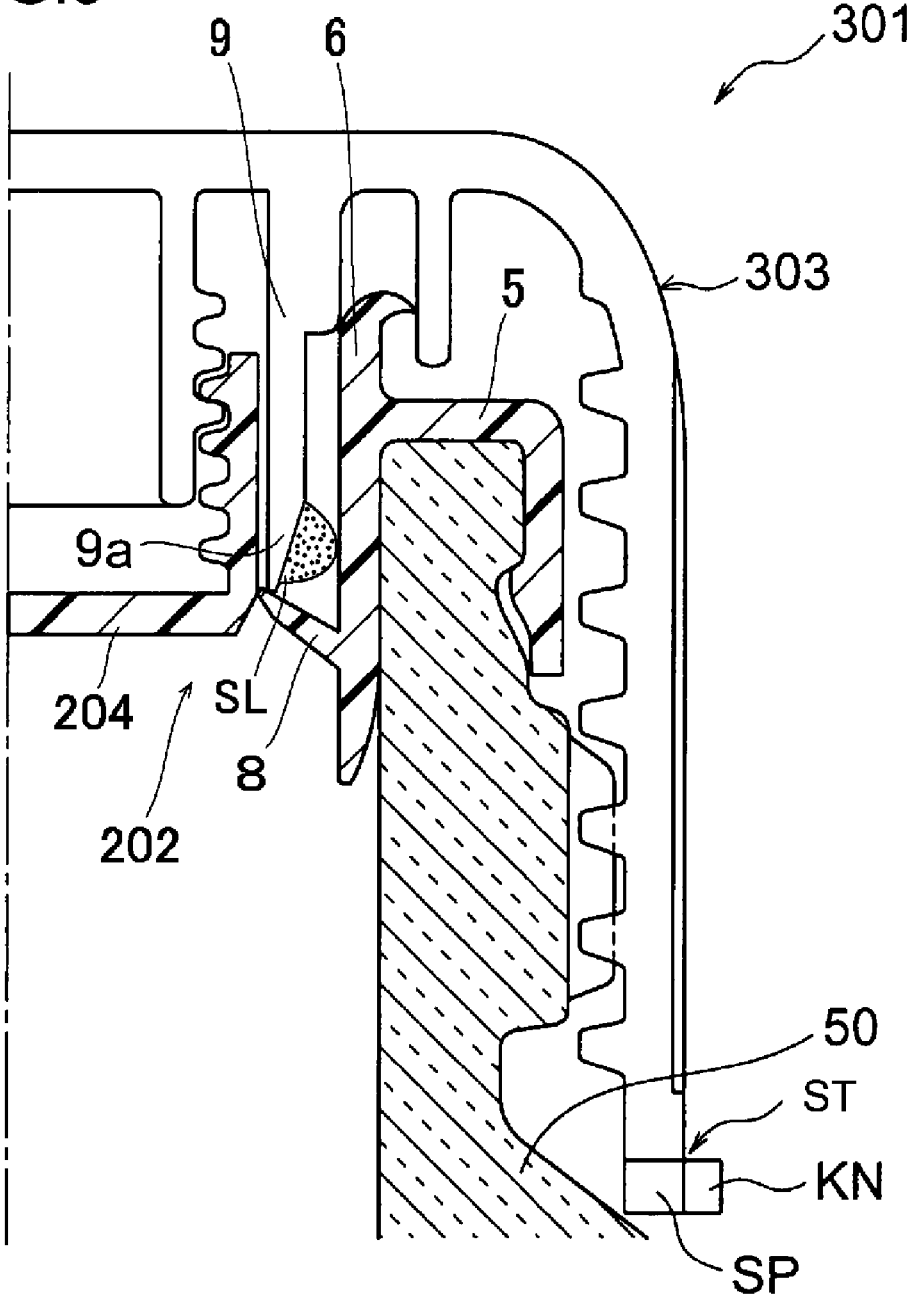
FIG. 9 is a cross-sectional view for illustrating a cap related to another variation of the second embodiment.

FIG. 9 is a cross-sectional view for illustrating a cap 301 that is provided with a different type seal as a variation of FIG. 8.

In this variation, as shown in the figure, a seal SL, which is an annular, relatively high protrusion, is disposed on the periphery of the lower end part 9*a* of the sleeve 9 of the overcap 303. In the case of this variation, when screwing the overcap 303 onto the container main body 50 once again subsequent to the overcap 303 first being unsealed in accordance with removing the stopper SP, the seal SL extends beyond the horizontal wall 8, reaching the underside of the horizontal wall 8, that is, the interior space side of the container main body 50. In other words, at this time, the outer circumference in the radial direction of the seal SL makes close contact with the surface of the inner wall of the pour-out cylinder part 6 at recapping. Consequently, it is possible to ensure a reliable liquid-tight state between the sleeve 9 and the pour-out cylinder part 6. That is, liquid leaks can be reliably prevented during repeated reuse subsequent to the initial unsealing. Furthermore, a seal SL such as that shown in FIG. 9 can also be disposed on the sleeves 9 of the overcaps 103, 203 shown in FIGS. 4 and 5.

Third Embodiment

FIGS. 10 through 13 are cross-sectional view showing the structure and operation of a cap of a third embodiment. In the resin-molded cap 401 of this embodiment, the inside plug 402 has a fitting part 405 and a main body part cylinder 406 as the main body part 420. Of these, the main body part cylinder 406 has the same role as the pour-out cylinder part 6 of the embodiments described hereinabove. This main body part 420 is fitted by sandwiching the mouth part 450*a* of the container main body 450 between an inner cylinder part of the fitting part 405, which is installed extending downwardly of the main body part cylinder 406, and an outer cylinder part, which extends to the outer side of this inner cylinder part. Further, the separating part 404 of the inside plug 402 comprises a separating part cylinder 404*b*, which is offset to the inner diameter side relative to the main body part cylinder 406 by the thickness of this main body part cylinder 406, and a ceiling wall 404*c*, which blocks upper part opening thereof, is stretch-installed on this separating part cylinder 404*b*. Furthermore, a flange 404*d*, which extends outwardly in the radial direction, is formed on the upper end of the separating part cylinder 404*b*. Then, the upper end of the main body part cylinder 406 and the lower end of the separation part-side cylindrical part 404*b* are contiguously connected by a thin-walled score 407.

Figure 10:
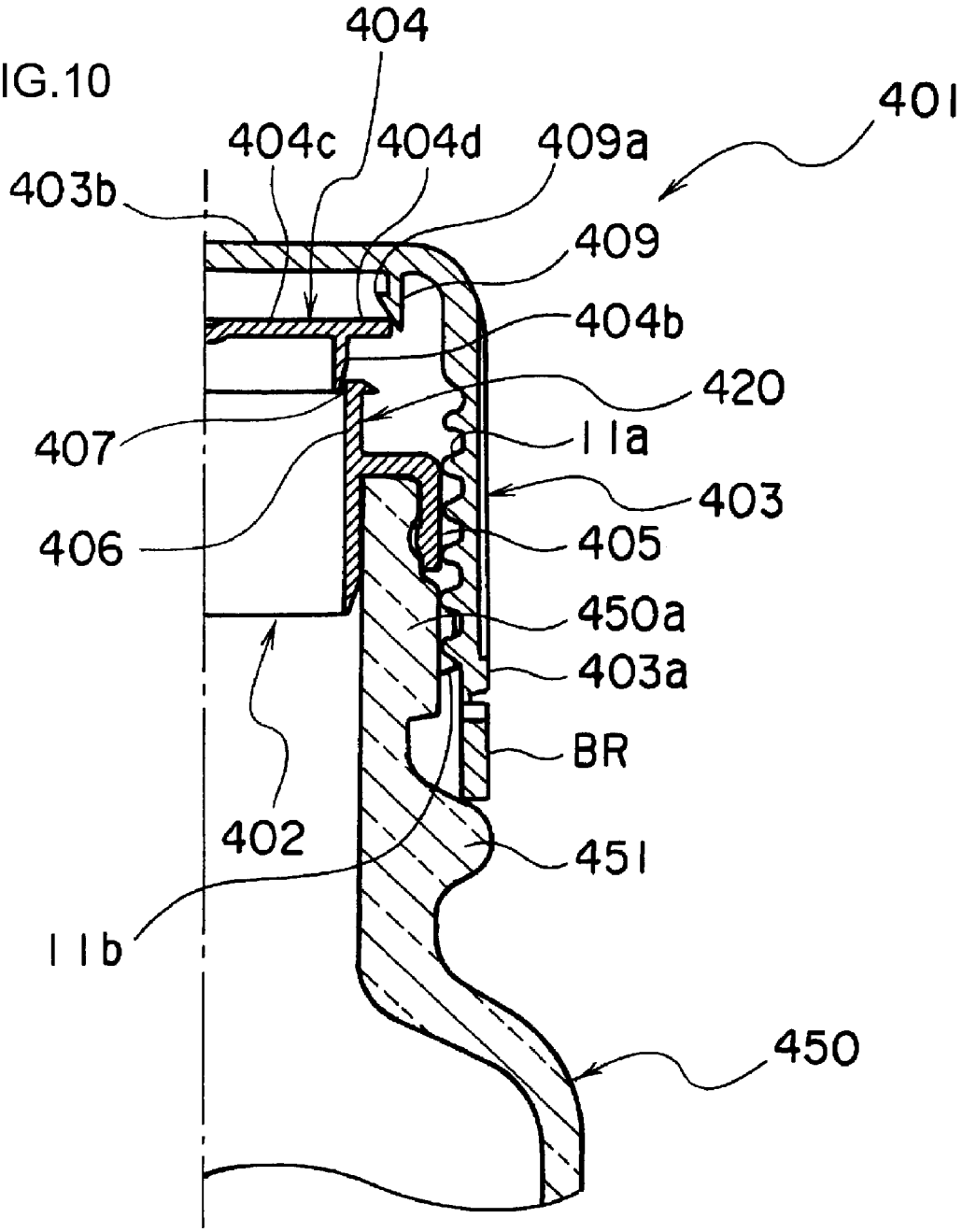
FIG. 10 is a cross-sectional view showing the closed state of the inside plug according to a cap related to a third embodiment.

Meanwhile, the overcap 403, which serves as the upper closure, comprises an annular protruding part 409 that extends downwardly from the bottom surface of an upper part wall 403*b*, and a claw 409*a*, which engages with the flange 404*d*, is formed at the lower end of this protruding part 409. Further, this overcap 403 has as a screwing part a female thread 11*a*, which is formed in the sidewall 403*a*, and a male thread 11*b*, which is formed on the side of the mouth part 450*a* of the container main body 450. Furthermore, the overcap 403 comprises a safety seal or a virgin ring BR at the lower end of the side wall 403*a*. The virgin ring BR is an annular band, and a notch is formed in an arbitrary location. Then, the overcap 403, as shown in FIG. 10, is screwed together with the mouth part 450*a* of the container main body 450, and the lower end of the virgin ring BR is positioned in close proximity to a bulge part 451, which is formed on the circumferential surface of the mouth part 450*a* of the container main body 450.

In a cap 401 configured like this, as will be explained in detail further below, the separating part 404 can be severed from the main body part cylinder 406 in accordance with the upper end wall 403*b* of the overcap 403, which can force down the separating part 402 of the inside plug 405. Further, the separating part 404 can be held by the overcap 403 in accordance with the protruding part 409, which has been formed in the overcap 403, and the flange 404*d* formed in the separating part 402, and an aperture part can be formed by separating the separating part 404 from the inside plug 405 in line with unsealing, which is carried out while rotating the overcap 403. That is, the protruding part 409, flange 404*d*, upper end wall 403*b* and so forth function as holding means, which engages with the separating part 404. In particular, the upper end wall 403*b* also functions as separating means for separating the separating part 404 from the main body part 420.

Figure 11:
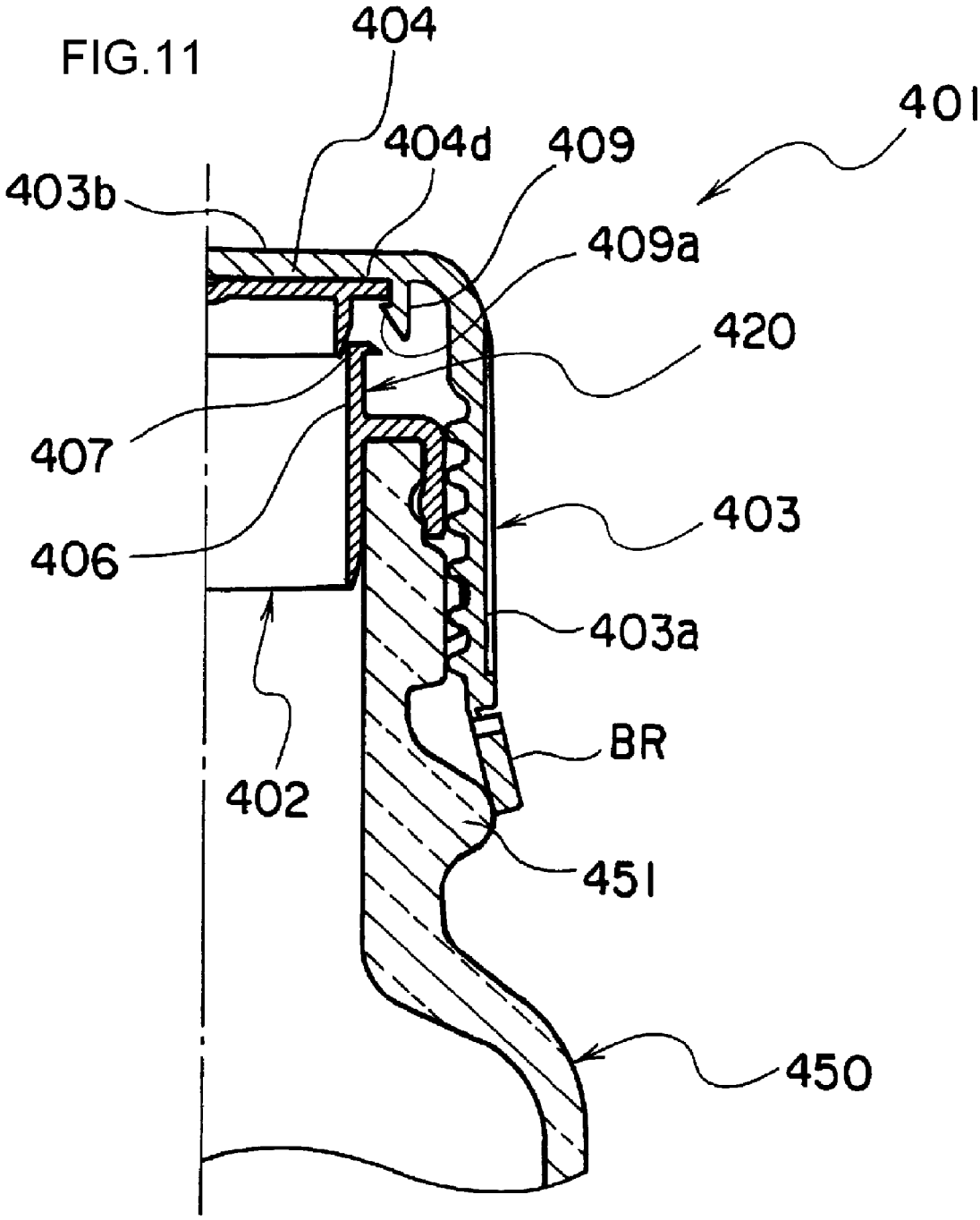
FIG. 11 is a cross-sectional view showing a first opening procedure of the inside plug according to the cap related to the third embodiment.

In severing the separating part 404 of the inside plug 402 from the main body part 420, first of all, the overcap 403 is rotated in the tightening direction, that is, clockwise. By so doing, as shown in FIG. 11, the virgin ring BR is expanded by the bulge part 451 of the container main body 450, and then is detached from the side wall 403*a*. Further, the protruding part 409 fits to the flange 404*d* of the inside plug 402, and the claw 409*a* engages with the bottom surface of the edge of the flange 404. That is, the separating part 404 is held by the overcap 403 side.

Figure 12:
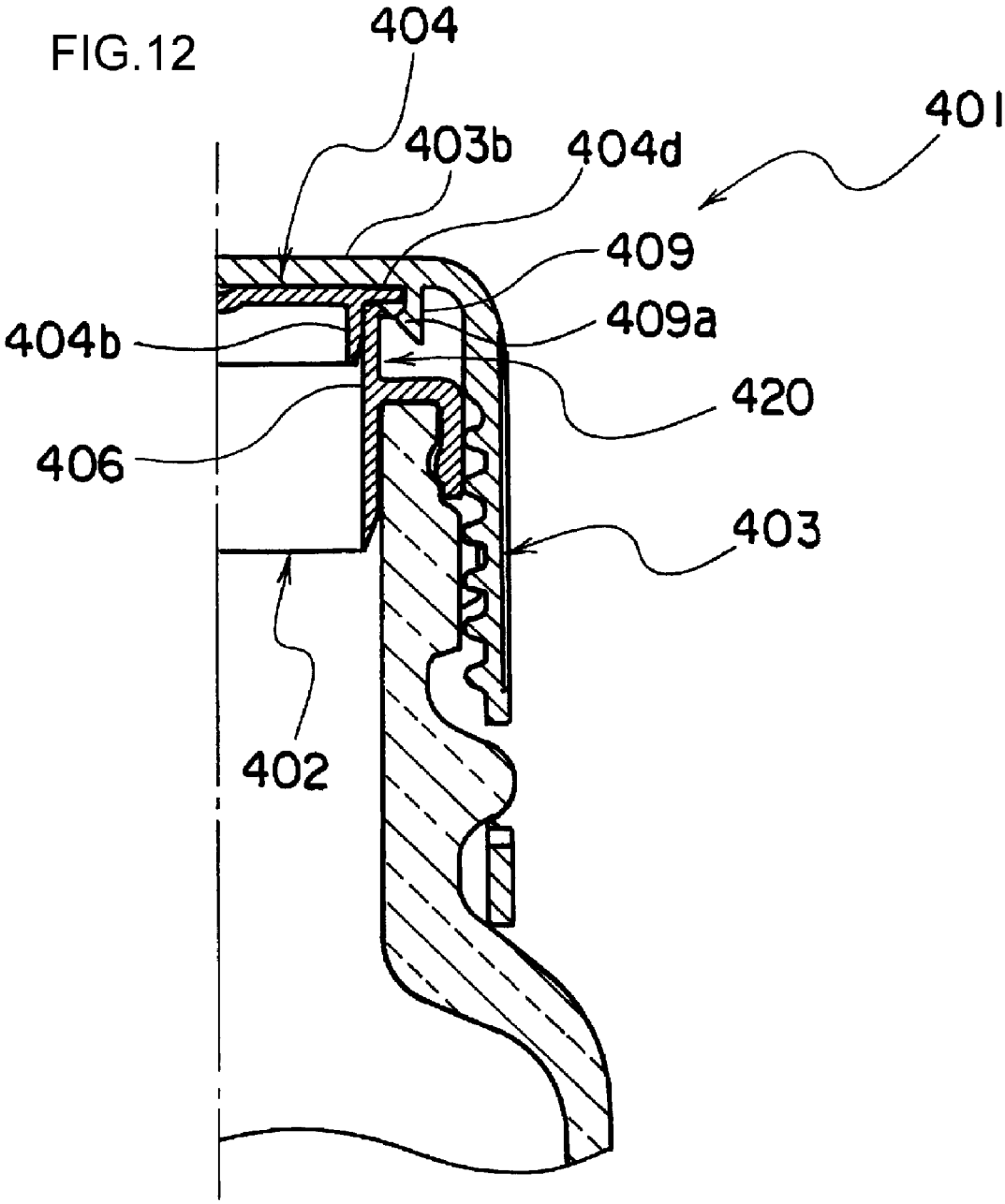
FIG. 12 is a cross-sectional view showing a second opening procedure of the inside plug according to the cap related to the third embodiment.

Furthermore, when the overcap 403 is tightened, the separating part 404 of the inside plug 402 is pushed downwardly by the upper end wall 403*b* of the overcap 403. By so doing, the score 407 is severed, and, as shown in FIG. 12, the separating part 404 is inserted into the cylindrical part 406 of the main body part 420. That is, the separating part 404 is severed from the main body part 420.

Figure 13:
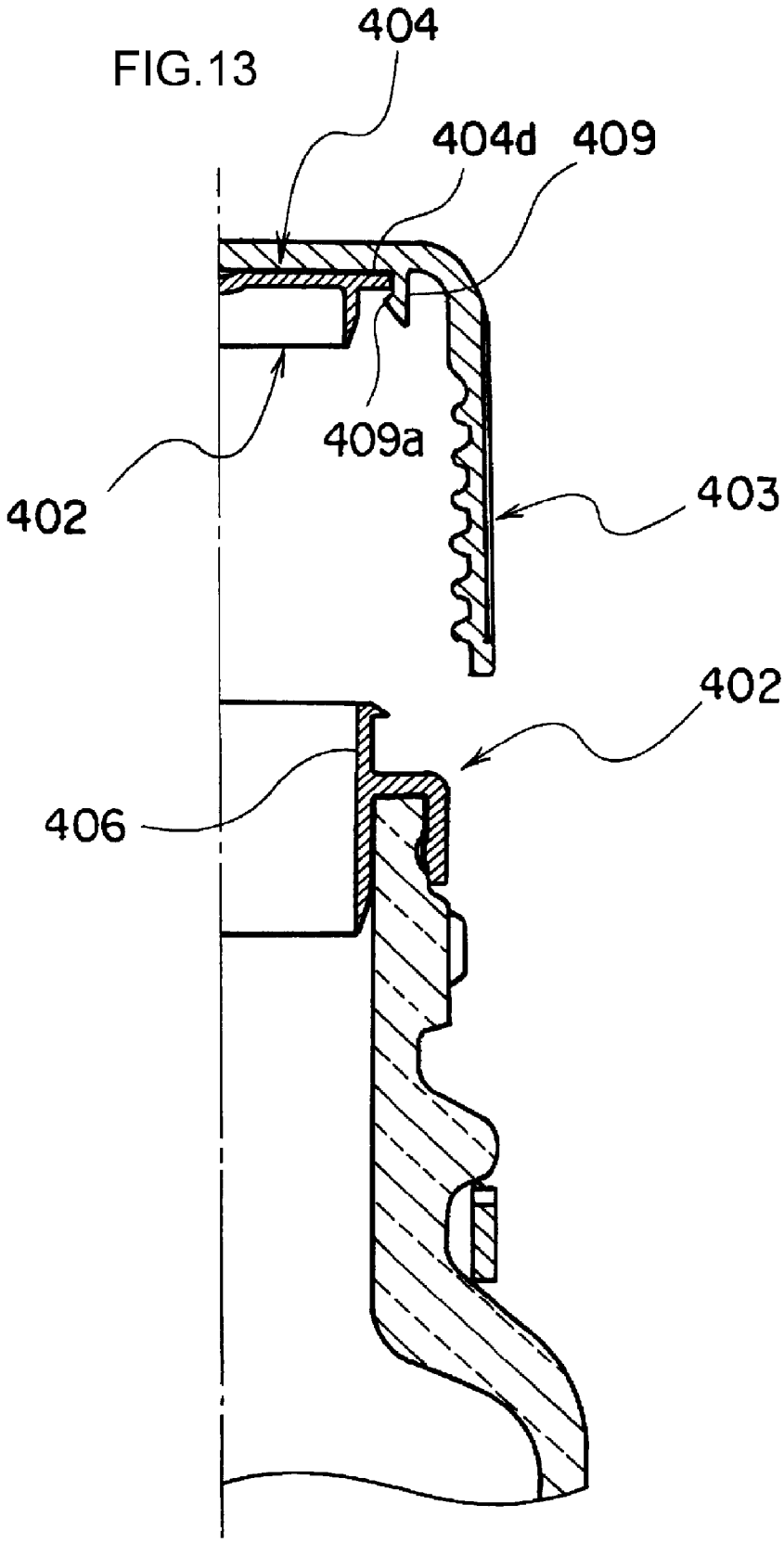
FIG. 13 is a cross-sectional view showing a third opening procedure of the inside plug according to the cap related to the third embodiment.

When the overcap 403 is rotating in the loosening direction in this state, as shown in FIG. 13, the separating part 404 of the inside plug 402 is detached from the cylindrical part 406 of the main body part 420 accompanying the overcap 403. Consequently, the inside plug 402 is unsealed.

Furthermore, the third embodiment hereinabove describes an inside plug 402 in a case in which the separating part cylinder 404*b* is offset to the inner side more than the main body part cylinder 406 by the thickness of the main body part cylinder 406, but the separating part cylinder 404*b* can also be offset to the outer side more than the main body part cylinder 406 by the thickness of the main body part cylinder 406.

Further, the inside plug 402 of the above-described third embodiment achieves water-tightness between the main body part cylinder 406 and the separating part cylinder 404*b* by contiguously connecting the two cylindrical parts via a score 407, but the score 407 is not necessarily required if the needed water-tight state is obtained by fitting the separating part cylinder 40 to the main body part cylinder 406.

Figure 14:
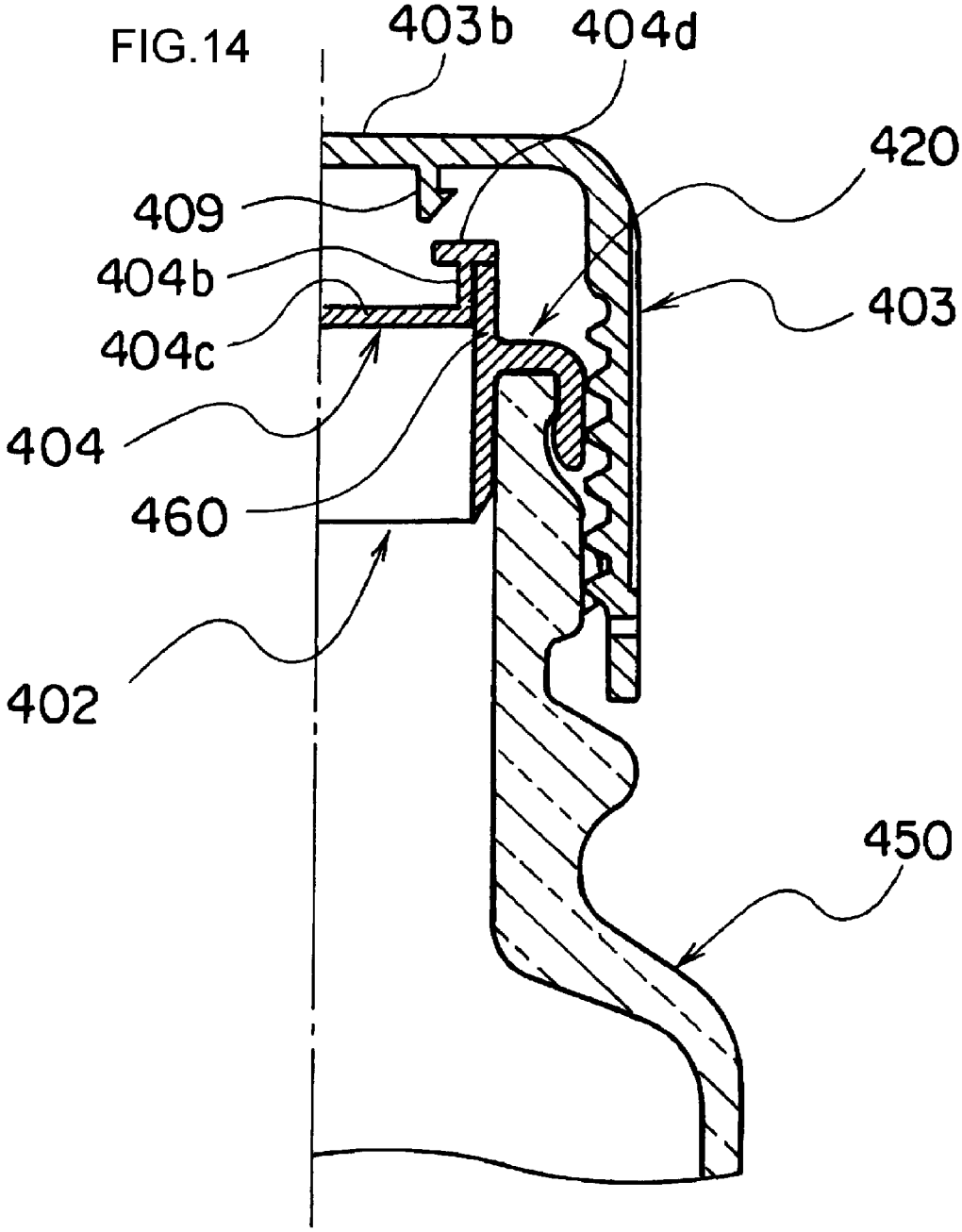
FIG. 14 is a cross-sectional view showing a cap related to a variation of the third embodiment.

Further, in the above-described third embodiment, the flange 404*d* of the inside plug 402 is formed facing outward in the radial direction, but as in the variation shown in FIG. 14, the flange 404*d* can also be formed facing inward in the radial direction.

Further, in the above-described third embodiment, a seal, which is an annular low protrusion, can be disposed in at least one of the outer circumference of the separating part cylinder 404*b*, or the inner circumference of the main body part cylinder 406. Providing a seal of this kind makes it possible to ensure a reliable liquid-tight state between the separating part cylinder 404*b* and the main body part cylinder 406. That is, it is possible to reliably prevent liquid leaks during repeated reuse subsequent to initial unsealing.

Fourth Embodiment

Figure 15A:
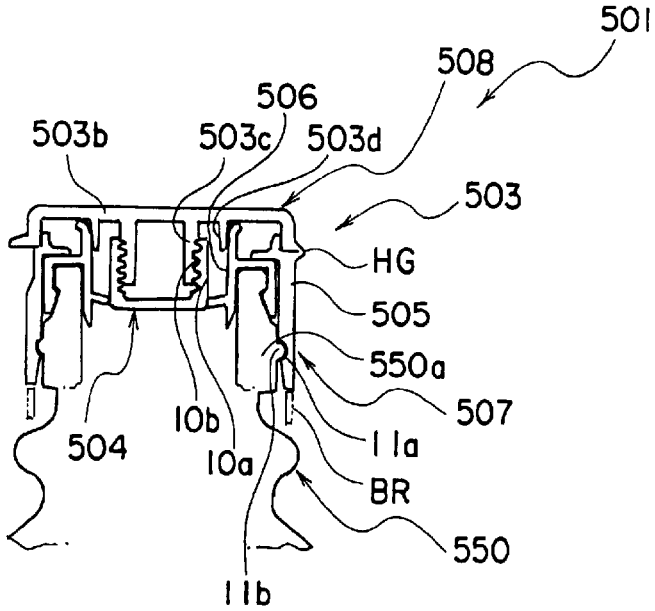
FIGS. 15*a* through 15*c* are cross-sectional views for illustrating a cap related to a fourth embodiment.
Figure 15B:
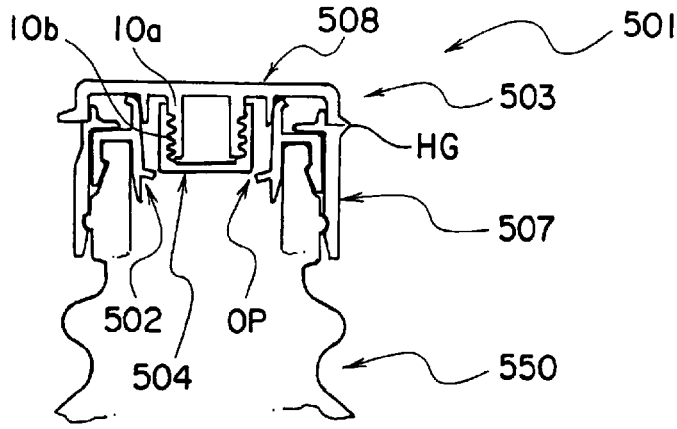
Figure 15C:
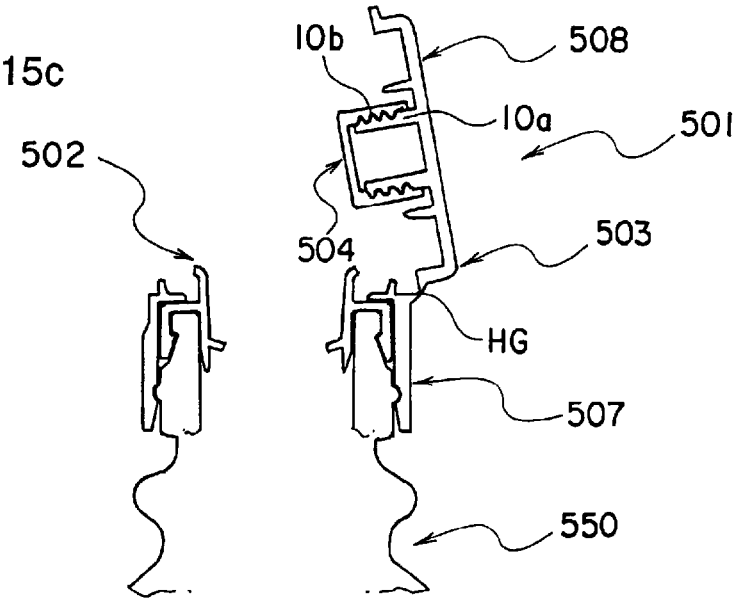

FIGS. 15*a* through 15*c* are cross-sectional views showing the structure and operation of a cap of a fourth embodiment. The overcap of the cap related to this embodiment constitutes a so-called hinged-cap type closure. In the resin-molded cap 501 of this embodiment shown in FIG. 15*a*, of the overcap 503 and internal plug 502, which make up the main configuration, the inside plug 502 is the same as the inside plug 2 shown in the above-described embodiment (for example, the first embodiment). That is, for example, the internal plug 502 has a fitting part 505 and a main body part cylinder 506 as the main body part 520, and also has a separating part 504, which is separated when the internal plug 502 is unsealed. Of these, for example, the main body part cylinder 506 has the same structure and role as the pour-out cylinder part 6 of the above-described embodiment. Therefore, a detailed explanation will be omitted.

Meanwhile, the overcap 503 related to this embodiment is an integrally molded component made of resin, and has a mounting part 507, which engages with the mouth part 550*a* of the container main body 550 and the inside plug 502; and an opening-and-closing lid 508, which is contiguously connected to the mounting part 507. The opening-and-closing lid 508 here is connected to the mounting part 507 via a hinging part HG. Consequently, the opening-and-closing lid 508 makes it possible to maintain a closed state, which covers the aperture part, and an open state, which opens the aperture part when using the cap 501 subsequent to carrying out an unsealing operation for the inside plug 502, which will be described hereinbelow.

The mounting part 507 has a female thread 11*a* on the inner side of a side wall 507*a*. Further, the opening-and-closing lid 508 has an upper end wall 503*b*, a connecting part 503*c*, and a sealing part 503*d*, and has a male thread 10*b* on the outer side of the connecting part 503*c*. The former female thread 11*a* is a screwing part, which constitutes a pair with a male thread 11*b* provided on the side of the mouth part 550*a* of the container main body 550. Conversely, the latter male thread 10*b* constitutes a pair with a female thread 10*a* disposed in the separating part 504, and is opening means, which tears off the separating part 504 from the inside plug 502 by screwing together with the female thread 10*a*, thereby carrying out either the opening or unsealing of the cap 501. The female thread 10*a* and the female thread 10*a* here can also be such that they fit together in a rotatable state without being screwed together. Further, the male thread 10*b* also functions as holding means that engages with the separating part 504. Further, the opening-and-closing lid 508 forms a dome-shaped exterior, and protects the inside plug 502 from the outside environment, such as dust and moisture.

The operation for unsealing the inside plug 502 in this embodiment will be explained below. FIG. 15*b* shows a cap 501 in an unsealed state. In this embodiment, a separating part 504, which is the separating part, is separated from an internal plug 502 and an aperture part OP is formed by screwing together a pair of a male thread 11*b* and a female thread 11*a*, which are the screwing part, the same as in the case of the first embodiment. That is, based on the state shown in FIG. 15*a*, the female thread 10*a*, which is disposed in the separating part 504, and the male thread 10*b*, which is disposed in the opening-and-closing lid 508 are thread fitted, that is, screwed together by twisting the overcap 503 in the tightening direction, that is, in the clockwise direction. Consequently, the aperture part OP is formed by the separating part 504 being pulled as if to be extracted in the upward direction relative to the sheet of paper. Furthermore, at this time, the virgin ring BR shown in FIG. 15*a* is expanded by the bulge part of the container main body 550, and then is detached from the side wall. As described hereinabove, subsequent to an unsealing operation being carried out for the inside plug 502, the opening-and-closing lid 508 makes opening-and-closing possible by adopting a closed state, which covers the aperture part OP of the cap 501 as shown in FIG. 15*b*, and an open state, which opens the aperture part OP as shown in FIG. 15*c*. At this time, the state is such that the separating part 504, which was separated during the internal plug 502 unsealing operation, is held by the opening-and-closing lid 508 because the female thread 10*a* and the male thread 10*b* are screwed together. Further, the separating part 504 is held by the opening-and-closing lid 508, and functions as an internal sealing plug that can block the aperture part OP after the inside plug 502 has been unsealed.

Fifth Embodiment

Figure 16A:
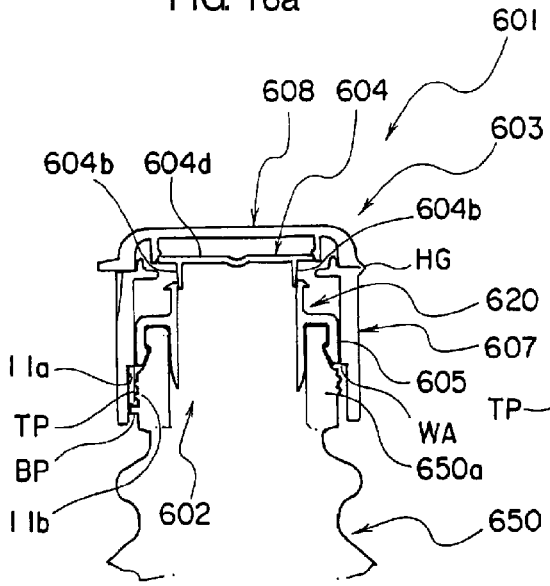
FIGS. 16*a* through 16*d* are cross-sectional views for illustrating a cap related to a fifth embodiment.

FIGS. 16*a* through 16*d* are cross-sectional views showing the structure and operation of a cap of a fifth embodiment. As shown in FIG. 16*a*, the internal plug 602 in the resin-molded cap 601 of this embodiment has a fitting part 605 and a main body part cylinder 606 as the main body part 620. Since the inside plug 602 here has the same configuration as that of the inside plug 402 shown in FIG. 10 and so forth showing the third embodiment, a detailed explanation will be omitted.

Conversely, the overcap 603 related to this embodiment is a hinged cap type the same as the case of the fourth embodiment, and the same as the overcap 503 of the fourth embodiment, has a mounting part 607, which engages with the mouth part 650*a* of the container main body 650 and the inside plug 602; and an opening-and-closing lid 608, which is connected to the mounting part 607 via a hinging part HG. Further, the same as the overcap 403 of the third embodiment, the opening-and-closing lid 608, which is one part of the overcap 603, comprises a protruding part 609, and a claw 609*a*, which engages with the flange 604*d* of a separating part 604, is formed at the lower end of this protruding part 609. The mounting part 607, which is also one part of the overcap 603, has the same configuration as that of the overcap 403 of the third embodiment, but in this embodiment, the mounting part 607 also has a protuberance part TP in at least one location of a diameter expansion part of the inner wall of the lower end part. By contrast to this, the container main body 650 has bump parts BP intermittently located on the circumference of a circle downwardly of the female thread 11*a* of the mouth part 650*a*. Constituting a state in which the protuberance part TP rides on top of the bump part BP, the female thread 11*a* of the mouth part 650*a* and the male thread 11*b* of the mounting part 607 are prohibited from being screwed together deeply.

Figure 16B:
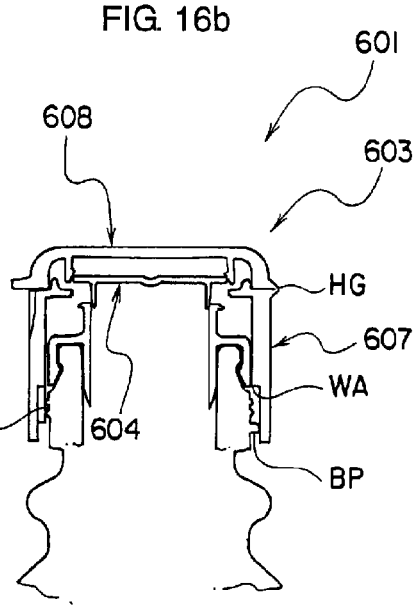

The operation for unsealing the inside plug 602 of this embodiment will be explained hereinbelow. FIG. 16*b* shows a state in which the protuberance part TP and the bump parts BP, which are intermittently located on the circumference of a circle, are positioned so as not to overlap in accordance with the twisting (for example, half rotation) of the overcap 603 in order to unseal the inside plug 602. In this case, it becomes possible to push in the entire overcap 603 to a location in which a step-shaped abutting part WA disposed on the inner wall of the mounting part 607 of the overcap 603 traverses the bump part BP. That is, it becomes possible to separate the separating part 604 from the inside plug 602 by a rotation operation of the overcap 603, thereby forming the aperture part OP (Refer to FIG. 16*d*). As described hereinabove, the positioning of the protuberance part TP and the bump part BP is carried out by a rotation operation of the overcap 603, and the protuberance part TP and the bump part BP function as push-in means for forming the aperture part OP by carrying out a push-in. Further, the protuberance part TP and the bump part BP can prevent the inadvertent unsealing of the inside plug, and, in addition, can relatively easily and reliably form the aperture part OP in accordance with a rotation operation and a push-in operation.

Figure 16C:
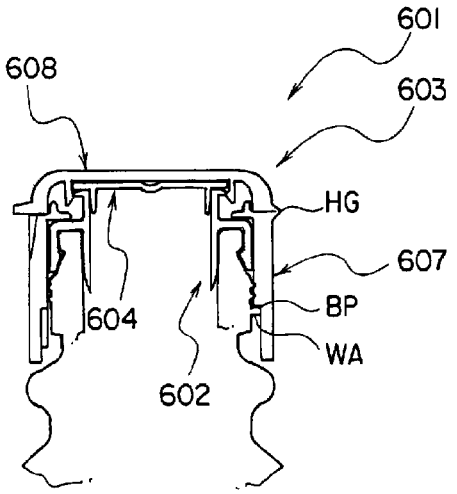

FIG. 16*c* is a diagram showing a state in which the overcap 603 has been pushed in. The separating part 604 of the inside plug 602 is severed from the main body part 620 by this push-in operation. More specifically, in accordance with a push-in operation, the protruding part 609 fits together with the flange 604*d* of the inside plug 602, the claw 609*a* engages with the bottom surface of the edge of the flange 604, and the protruding part 609 is pushed downwardly by the upper end wall 603*b* of the overcap 603. Thus, the separating part 604 of the inside plug 602 is severed from the main body part 620. Further, the mounting part 607 constitutes a state in which the mounting part 607 engages with the container main body 650.

Figure 16D:
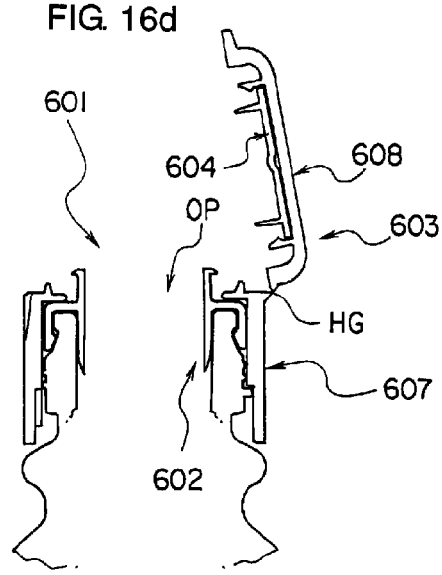

As described hereinabove, subsequent to an inside plug 602 unsealing operation being performed, the opening-and-closing lid 608 makes opening-and-closing possible by adopting a closed state, which covers the aperture part OP of the cap 601 as shown in FIG. 16*c*, and an open state, which opens the aperture part OP as shown in FIG. 16*d*. At this time, the state is such that the separating part 604, which was severed during the internal plug 602 unsealing operation, is held by the opening-and-closing lid 608 as a result of being fitted together with the protruding part 609 of the opening-and-closing lid 608. Therefore, the separating part 604 functions as an internal sealing plug that can block the aperture part OP after the inside plug 602 has been unsealed.

Sixth Embodiment

Figure 17:
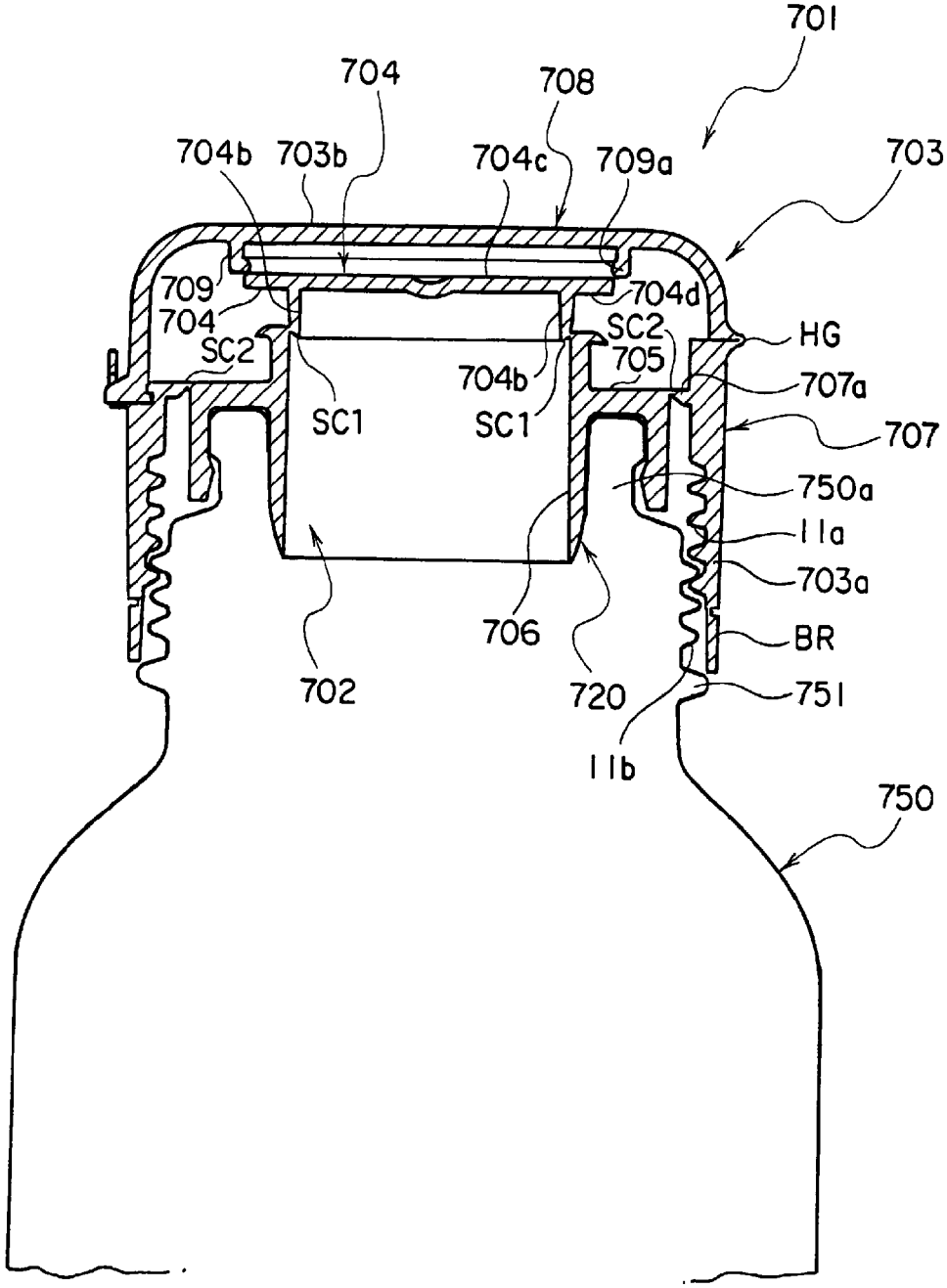
FIG. 17 is a cross-sectional view for illustrating a cap related to a sixth embodiment.

FIG. 17 is a cross-sectional view showing the structure of a cap of a sixth embodiment. The cap 701 related to this embodiment comprises an inside plug 702; and an overcap 703, which is the upper closure. In particular, in this embodiment, the cap 701 is molded from resin, and the inside plug 702 and overcap 703 are integrally molded as a single article.

The inside plug 702 comprises a separating part 704; a main body part 720; and a main body part cylinder 706. Further, the main body part 720 has a fitting part 705; and the main body part cylinder 706. The inside plug 702, together with the container main body 750, forms an airtight space that encloses the contents either air-tightly or liquid-tightly.

The main body part cylinder 706 is an overall cylindrical shape, and has a shape in which the outside diameter increases in the upper end part, improving drainability when pouring out a liquid from inside the container main body 750.

Further, the separating part 704 comprises a separating part cylinder 704*b*, which is offset to the internal diameter side relative to the main body part cylinder 706 by the thickness of this main body part cylinder 706, and a ceiling wall 704*c*, which blocks an upper part opening thereof, is stretch-installed on this separating part cylinder 704*b*. Furthermore, a flange 704*d*, which extends outwardly in the radial direction, is formed on the upper end of the separating part cylinder 704*b*. Then, the upper end of the main body part cylinder 706 and the lower end of the separating part cylinder 704*b* are contiguously connected by a thin-walled score SC1. This separating part 704 is severed along the score SC1 when the inside plug 702 is unsealed, and an aperture part is formed by the main body part 720 remaining in the mouth part 750*a* side.

Further, the fitting part 705 is a fitting member for fitting and fastening the inside plug 702 to the mouth part 750*a* of the container main body 750. More specifically, the structure of the fit according to the fitting part 705 is such that this main body part 720 is fit so as to sandwich the mouth part 750*a* of the container main body 750 with the fitting part 705 inner cylinder part, which extends downwardly of the main body part cylinder 706, and an outer cylinder part, which extends to the outer side of this inner cylinder part.

Next, the overcap 703, which is the upper closure of the inside plug 702, is a hinged cap type, and has a mounting part 707 engaging with the inside plug 702, and an opening-and-closing lid 708 connected to the mounting part 707 via a hinging part HG.

The opening-and-closing lid 708 here, by being connected to the mounting part 707 via the hinging part HG, is able to maintain a closed state, in which an aperture part is covered, and an open state, in which the aperture part is open when using the cap 701 subsequent to the inside plug 702 unsealing operation, which will be explained hereinbelow, having been carried out, that is, when opening and closing the cap 701 during re-use after initial unsealing.

The mounting part 707 has a female thread 11*a* on the inner side of a side wall 703*a*. The female thread 11*a* is a screwing part, which constitutes a pair with a male thread 11*b* provided on the side of the mouth part 750*a* of the container main body 750. Furthermore, the opening-and-closing lid 708 forms a dome-shaped exterior, thereby protecting the inside plug 502 from the outside environment, such as dust and moisture.

Further, the opening-and-closing lid 708, which is one part of the overcap 703, comprises a protruding part 709, and a claw 709*a*, which engages with a flange 704*d* of a separating part 704, is formed at the lower end of this protruding part 709. Further, the mounting part 707, which is also one part of the overcap 703, comprises a virgin ring BR at the lower end of the side wall 703*a*. The virgin ring BR is an annular band, and a notch is formed in an arbitrary location. Then, the overcap 703, as shown in FIG. 17, is screwed together with the mouth part 750*a* of the container main body 750, and the lower end of the virgin ring BR is positioned in close proximity to a bulge part 751, which is formed on the circumferential surface of the mouth part 750*a* of the container main body 750.

Furthermore, in this embodiment, a protruding part 707*a*, which extends sideways from the inner circumference surface of the mounting part 707 of the overcap 703, and the outer circumference of the upper end part of the fitting part 705 of the inside plug 702 are contiguously connected via a thin-walled score SC2. Consequently, the inside plug 702 and the overcap 703 are integrally molded as a single article. Furthermore, as will be explained hereinbelow, the mounting part 707 is severed from the inside plug 702 at the thin-walled score SC2 due to a rotation operation relative to the male thread 11*b* of the female thread 11*a*.

In a cap 701 configured like this, as will be explained in detail hereinbelow, the separating part 704 can be severed from the main body part cylinder 706 by the upper end wall 703*b* of the overcap 703, which can push down on the separating part 704 of the inside plug 702. Further, the separating part 704 can be held to the side of the overcap 703 by the protruding part 709 formed in the overcap 703 and the flange 704*d* formed in the separating part 702, and the separating part 704 can be separated from the inside plug 702 in line with the unsealing of the inside plug 702, which is carried out while rotating the overcap 703, thereby forming an aperture part. That is, the protruding part 709, flange 704*d*, upper end wall 703*b* and so forth function as holding means that engages with the separating part 704. In particular, the upper end wall 703*b* also functions as separating means for separating the separating part 704 from the main body part 720.

Figures 18A, 18B:
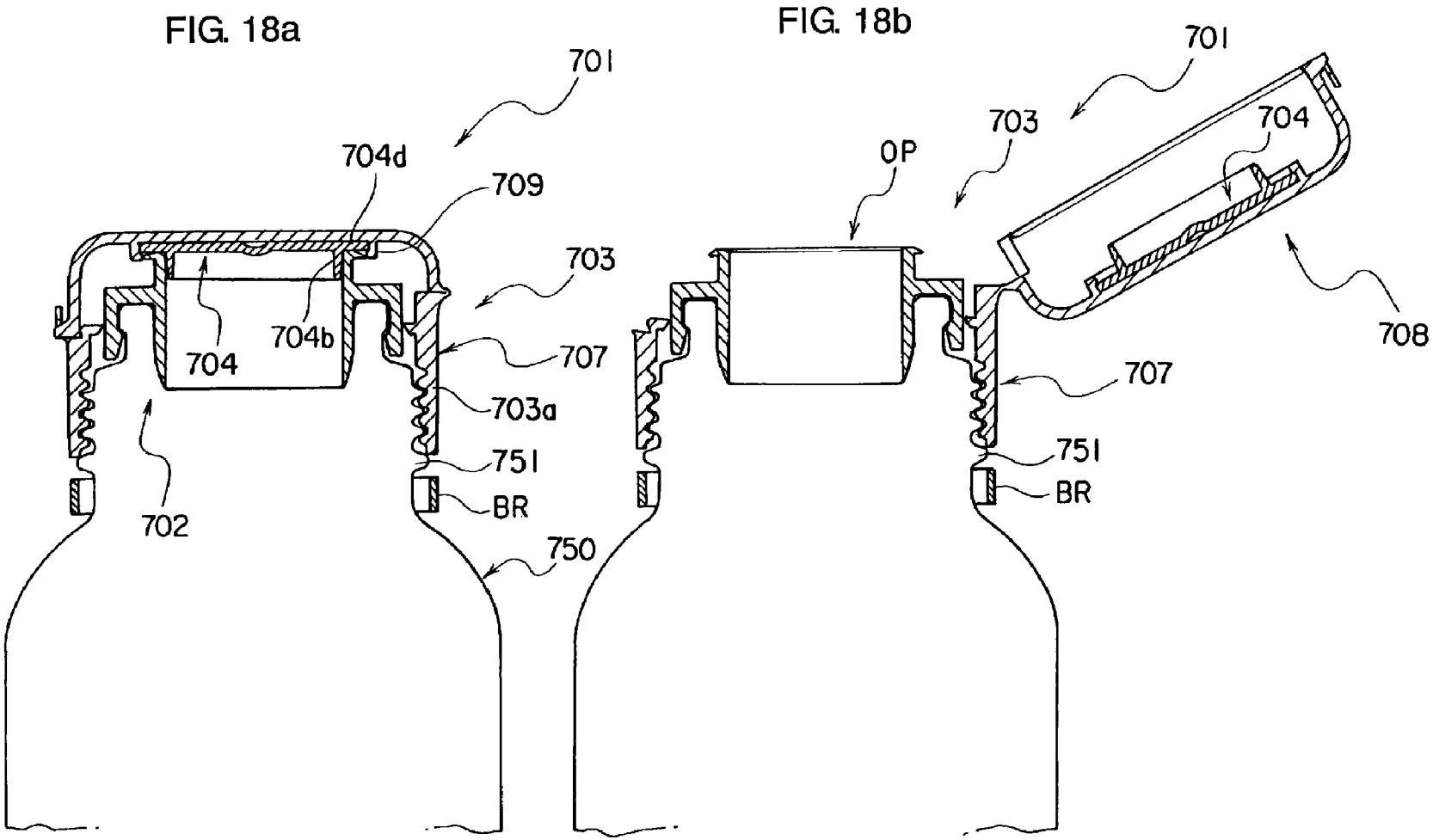
FIGS. 18*a* and 18*b* are cross-sectional views for illustrating the operation of the cap related to the sixth embodiment.

FIGS. 18*a* and 18*b* are diagrams showing the unsealing operation of the inside plug 702. The inside plug 702 unsealing operation will be explained hereinbelow using FIGS. 18*a* and 18*b*.

In severing the separating part 704 of the inside plug 702 from the main body part 720, first of all, the overcap 703 is rotated in the tightening direction, that is, clockwise. In so doing, as shown in FIG. 18*a*, the virgin ring BR is expanded by the bulge part 751 of the container main body 750 and detached from the side wall 703*a*. Further, the protruding part 709 fits to the flange 704*d* of the inside plug 702, and the claw 709*a* engages with the bottom surface of the edge of the flange 704*d*. That is, the separating part 704 is held by the overcap 703.

Furthermore, when tightening the overcap 703, the separating part 704 of the inside plug 702 is pushed downwardly by the upper end wall 703*b* of the overcap 703. In so doing, the score SC1 is separated, and the separating part 704 is inserted into the cylindrical part 706 of the main body part 720. That is, the separating part 704 is severed from the main body part 720.

Further, the score SC2 is cut due to the rotating of the overcap 703 in the tightening direction, and the mounting part 707 of the overcap 703 is severed from the inside plug 702. At this time, the mounting part 707 engages with the container main body 750 in accordance with the female thread 11*a* and the male thread 11*b* being screwed together.

As described hereinabove, subsequent to an inside plug 702 unsealing operation being carried out, the opening-and-closing lid 708 makes opening-and-closing possible by adopting a closed state, which covers the aperture part OP of the cap 701 as shown in FIG. 18*a*, and an open state, which opens the aperture part OP as shown in FIG. 18*b*. At this time, the state is such that the separating part 704, which was severed during the internal plug 702 unsealing operation, is held by the opening-and-closing lid 708 as a result of being fitted together with the protruding part 709 of the opening-and-closing lid 708. Therefore, the separating part 704 functions as an internal sealing plug that can block the aperture part OP after the inside plug 702 has been unsealed.

Furthermore, in the above-described sixth embodiment, there is described an inside plug 702 of a case in which the separating part cylinder 404*b* is offset to the inside more than the main body part cylinder 406 by the thickness of the main body part cylinder 706, but the separating part cylinder 704*b* can also be offset to the outside more than the main body part cylinder 706 by the thickness of the main body part cylinder 706.

Further, the inside plug 702 of the above-described sixth embodiment strives for water-tightness, that is, liquid-tightness between the main body part cylinder 706 and the separating part cylinder 704*b* by contiguously connecting the two cylindrical parts via the score SC1, but the score 707 is not necessarily required if the needed water-tight state, that is, liquid-tight state is obtained by fitting the separating part cylinder 704*b* to the main body part cylinder 706.

Further, in the above-described third embodiment, a seal, which is an annular low protrusion, can be disposed in at least one of the outer circumference of the separating part cylinder 704*b*, or the inner circumference of the main body part cylinder 706. Providing a seal of this kind makes it possible to ensure a reliable liquid-tight state between the separating part cylinder 704*b* and the main body part cylinder 706. That is, it is possible to reliably prevent liquid leaks during repeated reuse subsequent to initial unsealing.

Figure 19B:
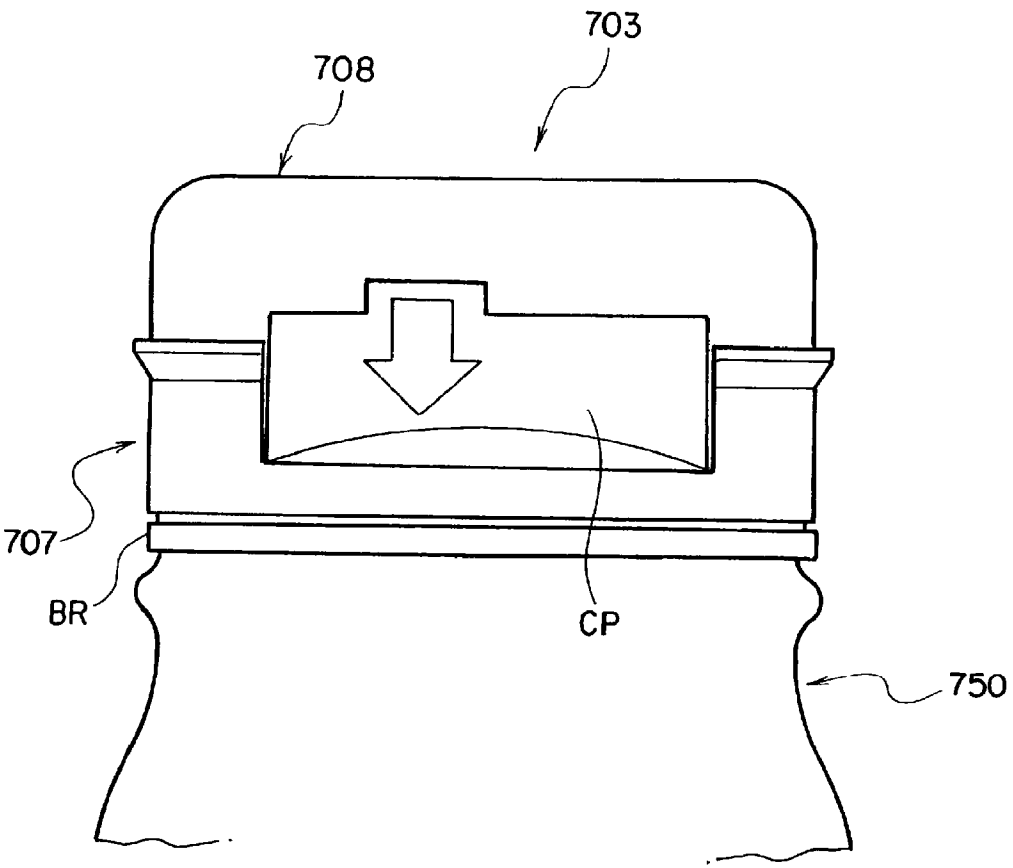
FIGS. 19*a* and 19*b* are cross-sectional views showing a cap related to a variation of the sixth embodiment.
Figure 19A:
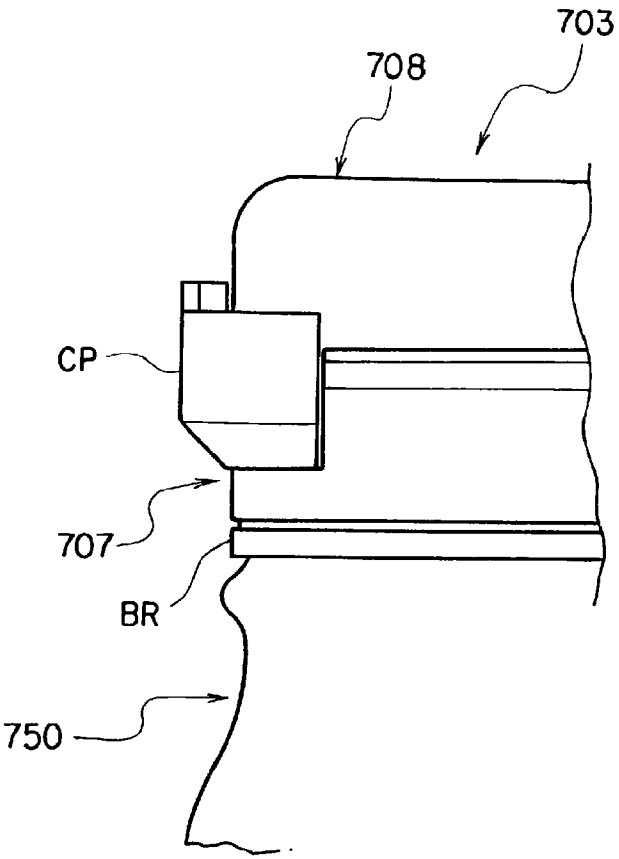

Furthermore, for the respective hinged-type caps described hereinabove, in order to prevent an inside plug unsealing operation, a belt-shaped cover member CP can be used as locking means for suppressing the lid-opening operation of the opening-and-closing lid 708 as shown, for example, in FIGS. 19*a* and 19*b*. That is, in this case, the constitution is such that it is not possible to unseal the open-and-closing lid 708 without first peeling off the cover member CP in the direction of the arrow in FIG. 19*b*, and consequently, since a lid-opening operation resulting from a malfunction or vandalism cannot be carried out prior to unsealing, the reliability of the cap's seal can be enhanced.

Seventh Embodiment

Figures 20A, 20B, 20C, 20D, 20E, 20F, 20G, 20H:
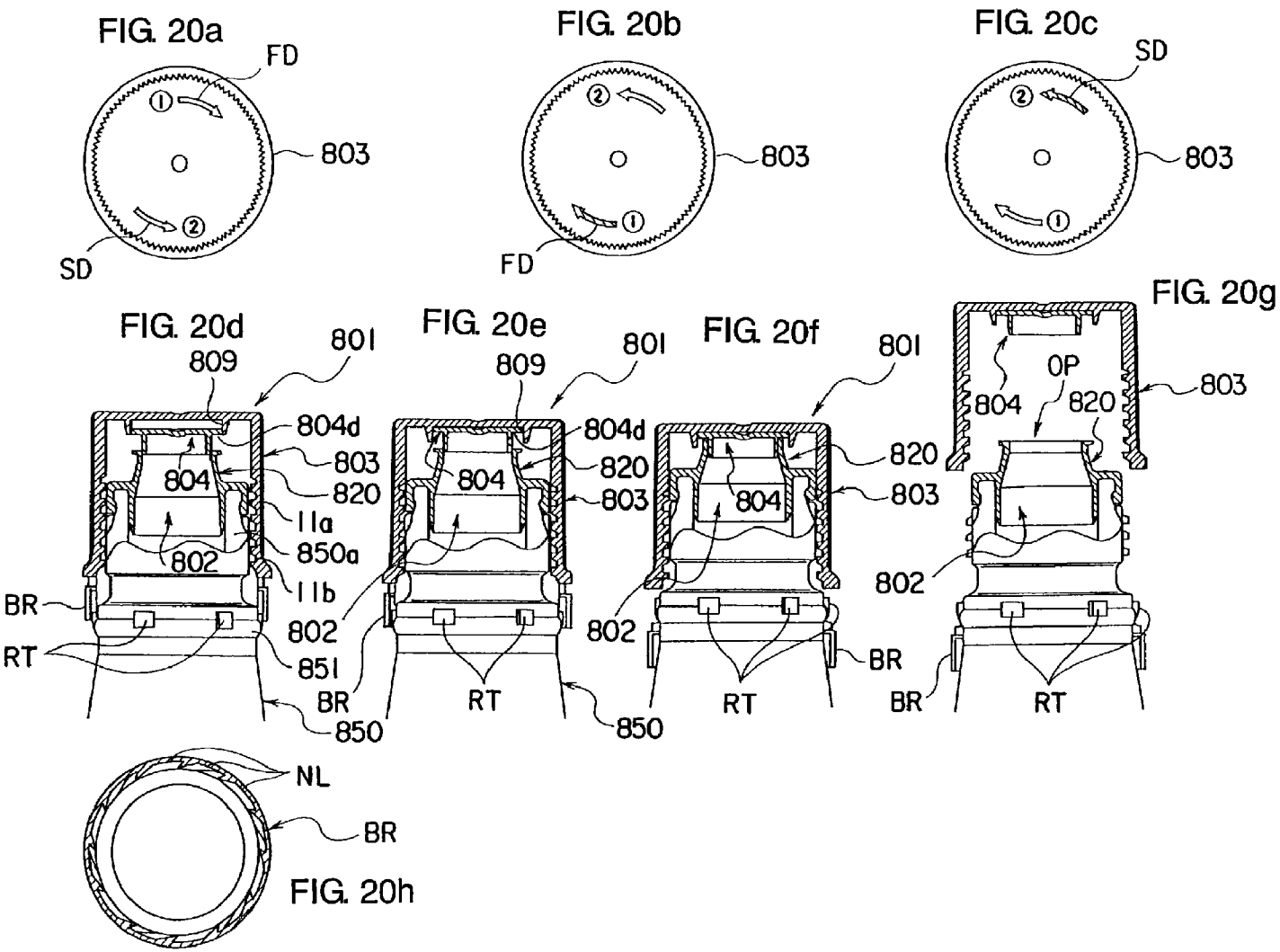
FIGS. 20*a* through 20*h* are diagrams illustrating a cap related to a seventh embodiment.

FIGS. 20*a* through 20*h* are diagrams showing the structure and operation of a cap of a seventh embodiment. FIGS. 20*a* through 20*c* are planar views showing the top surface of an overcap. Further, FIGS. 20*d* through 20*g* are partial cross-sectional views for illustrating a cap unsealing operation. Further, FIG. 20*h* is a planar view for illustrating a virgin ring disposed on the lower end of the overcap. The cap 801 of this embodiment is molded from resin, and, for example, as shown in FIG. 20*d*, comprises an inside plug 802 and an overcap 803, and, with the exception of the virgin ring BR and structure of the container main body 850, since this cap 801 has the same structure as that of the cap 401 in the third embodiment, a detailed explanation will be omitted. Furthermore, as shown in FIG. 20*a* for example, numbers and arrows indicating the direction of rotation for showing a user the opening method are displayed on the top surface of the overcap 803. Furthermore, this same display can be used on the top surface of the overcap 403 in the third embodiment as well.

Here, as shown in FIG. 20*d*, a plurality of projection-shaped ratchets RT is disposed at equal intervals annularly along the outer surface of the bulge part 851 on the container main body 850 of this embodiment. Meanwhile, in contrast to this, claws NL are formed at equal intervals, corresponding to the intervals of the ratchets RT, annularly along the inner surface of the virgin ring BR of the cap 801 as shown in FIG. 20*h*. The ratchets RT and claws NL here form a ratchet structure. That is, the cap 801 is locked to the container main body 850 in a state in which the cap 801 interlocks with the ratchets RT via the claws NL of the virgin ring BR, and the direction of rotation of the cap 801 is restricted to one direction by this ratchet structure when unsealing the inside plug 802. Therefore, in this case, the ratchets RT and claws NL function as a rotation suppressing mechanism, which limits the direction of rotation in an opening operation.

The operation for unsealing the cap 801 of this embodiment will be explained hereinbelow using FIGS. 20*e* and 20*f*. First, in FIG. 20*e*, the overcap 803 is rotated in the tightening direction, that is, clockwise to sever a separating part 804 of the inside plug 802 from a main body part 820. Here, as described hereinabove, it is only possible to rotate the overcap 803 in the clockwise direction due to the ratchet structure resulting from the ratchets RT and claws NL. Furthermore, at this time, for example, there is an explanation (not shown in the figure) on a label attached to the side of the container main body 850 directing the user to rotate the overcap 803 in the direction of the arrow pointing to the number 1 for the initial unsealing, and, by referring to this description, the user recognizes that, of the directions of the number-displayed arrows on the overcap 803, the direction of rotation for the initial unsealing is the direction of arrow FD, which indicates clockwise, as shown in FIG. 20*b*.

As described above, tightening the overcap 803 as shown in FIG. 20*e* causes the virgin ring BR to move downwards and expand while traversing the bulge part 851 of the container main body 850. Further, the separating part 804 is held to the overcap 803 side at this time by virtue of the protruding part 809 being fitted to the flange 804*d*.

Furthermore, when the overcap 803 is tightened, the virgin ring BR completely traverses the bulge part 851, and is cut into a strip and detached from the overcap 803 as shown in FIG. 20*f*. Further, the separating part 804 of the inside plug 802 is pushed downward at this time, and the separating part 804 is severed from the main body part 820.

Thus, when the virgin ring BR detaches from the overcap 803, the direction of rotation of the overcap 803 is no longer restricted by the ratchets RT, making it possible to rotate in the opposite direction from that at the time of unsealing. This time, the user rotates the overcap 803 in the direction of the SD arrow shown in FIG. 20*c* in accordance with the not-shown explanation the same as above, and the separating part 804 of the inside plug 802 is detached from the main body part 820 in association with the overcap 803 as shown in FIG. 20*g*. The inside plug 802 is unsealed by a two-stage operation corresponding to arrows FD and SD as above. Furthermore, this also forms the aperture part OP as shown in FIG. 20*g*. Further, when the overcap 803 is retightened subsequent to unsealing, the cap 801 returns to the state shown in FIG. 20*f*, and the aperture part OP is covered by the separating part 804.

As described hereinabove, the ratchets RT of the container main body 850 and the claws NL of the overcap 803 can restrict to a single direction the rotation direction of the initial rotation operation for unsealing, making rotation in the opposite direction impossible, thereby preventing malfunctions at the time of unsealing. Furthermore, displaying the rotation directions on the top surface of the overcap 803 makes it possible to alleviate confusion on the part of the user. Furthermore, the above-described ratchet structure can be used similarly for the hinge-type cap described in the fifth embodiment.

Figure 21A:
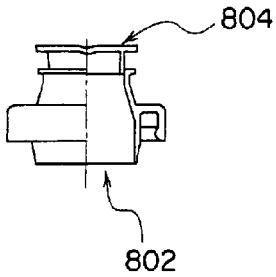
FIGS. 21*a* through 21*e* are diagrams illustrating a covered container related to the seventh embodiment.
Figure 21B:
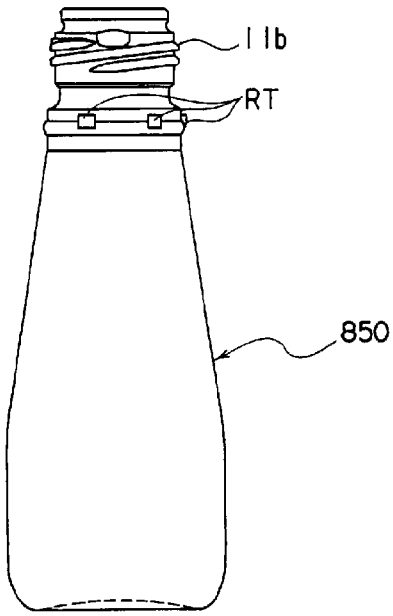
Figure 21C:
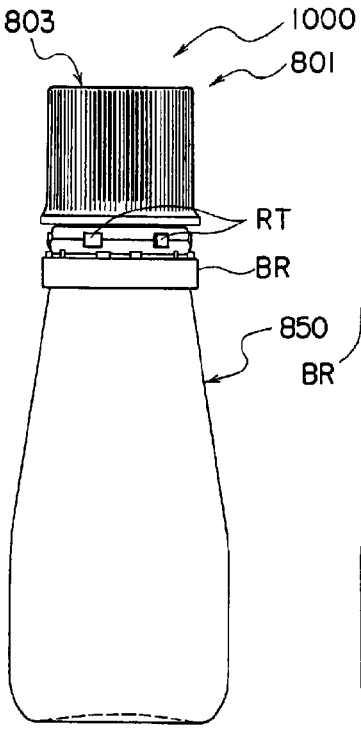
Figure 21D:
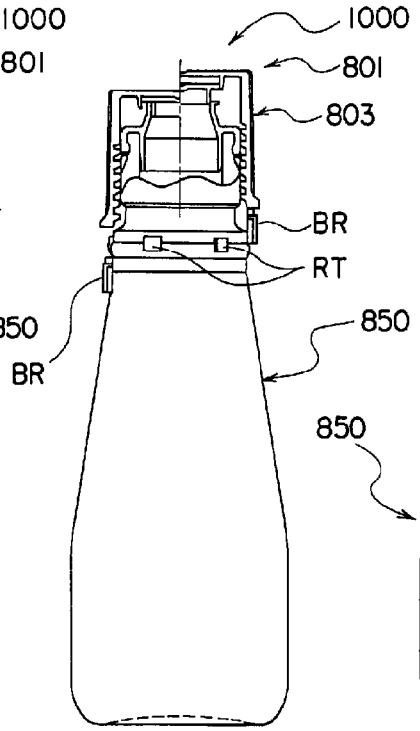
Figure 21E:
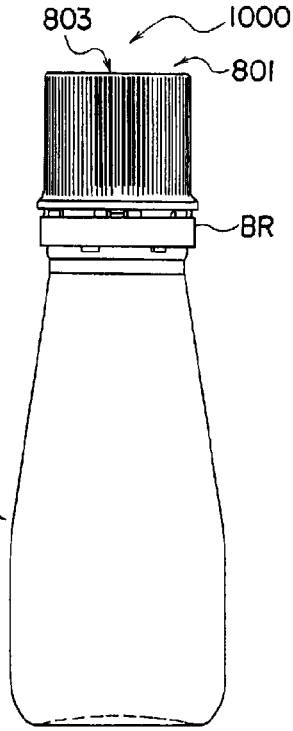

FIGS. 21*a* through 21*e* are diagrams showing examples of covered containers that utilize the cap 801 related to the above-described embodiment. FIG. 21*a* is a partial cross-sectional view showing the inside plug 802 of the cap 801, FIG. 21*b* is a diagram showing the container main body 850 of the cap 801, and FIGS. 21*c* through 21*e* are diagrams showing a covered container 1000 that uses the cap 801. The inside plug 802 that comprises the separating part 804 shown in FIG. 21*a*, together with the container main body 850 shown in FIG. 21*b*, forms an airtight space that encloses a liquid, which is the contents stored in the container main body 850. The overcap 803 is attached to the container main body 850 in which the airtight space has been formed as shown in FIG. 21*e*. The virgin ring BR of the overcap 803 is locked by the ratchets RT at this time, and the overcap 803 is stopped before being tightened. A covered container 1000 prior to being unsealed is configured in a state like this. FIG. 21*c* here is a diagram showing the covered container 1000 in a state subsequent to the above-described initial unsealing of the cap 801 being carried out. That is, FIGS. 21*e* and 21*c* show the states before and after the initial unsealing of the cap 801, and FIG. 21*d* shows a comparison of these two states. Furthermore, as is clear from FIGS. 21*c* through 21*e*, subsequent to the initial unsealing, the separating part 804 of the cap 801 functions as an internal sealing plug that makes it possible to cover the aperture part after the inside plug 802 has been unsealed by tightening the overcap 803 to the tightened sealed position by screwing in the overcap 803 clockwise for initial unsealing.

Figure 22A:
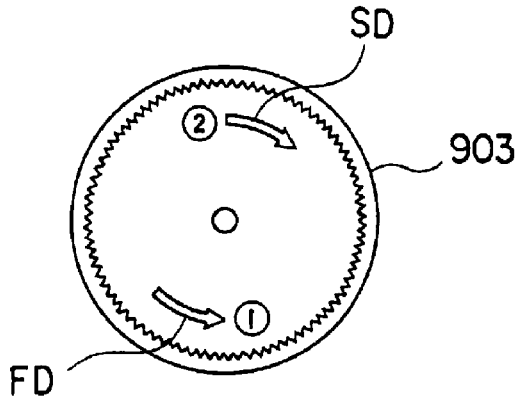
FIGS. 22*a* through 22*c* are diagrams illustrating a cap related to a variation of the seventh embodiment.
Figure 22B:
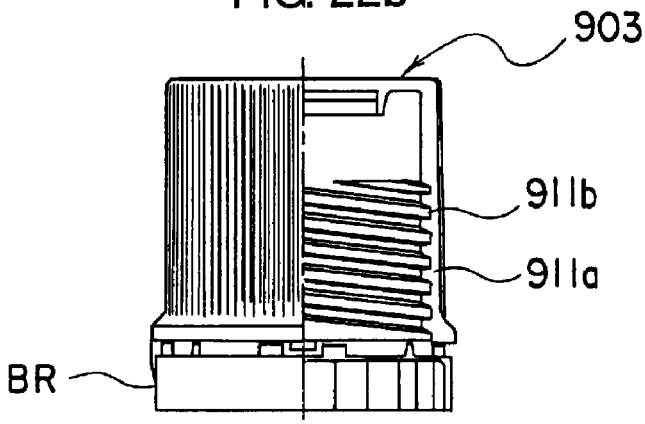
Figure 22C:
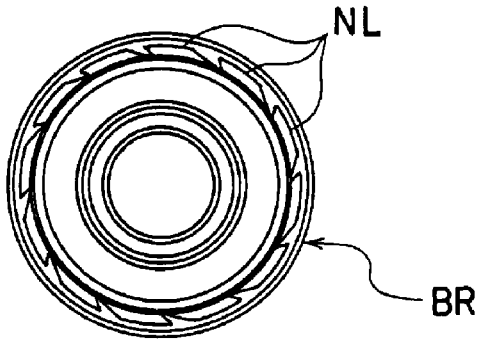

FIGS. 22*a* through 22*c* are diagrams for illustrating a variation of this embodiment. In the case of this variation, a screwing part, which is configured by a female thread 911*a* and a male thread 911*b* as shown in FIG. 22*b*, normally constitutes a reverse left-handed thread. That is, in this case, the direction of the rotation operation for forming the aperture part is the counterclockwise direction. Therefore, as shown in FIG. 22*c*, the orientation of the claws NL disposed on the virgin ring BR is in the opposite direction than it was in the above-described case (refer to FIG. 20*h*), and, consequently, the resin-molded overcap 903 is only able to rotate in the counterclockwise direction when carrying out the initial operation at the time of unsealing. That is, in this case, the overcap 903 is tightened by rotating counterclockwise, which for a normal cap would be the operation that opens the cap. Further, for this reason, the display of the numbers 1 and 2 showing the procedure for the rotation directions of the arrows FD and SD shown in FIG. 22*a* has been switched around from what it was in FIG. 20*a*. In this case, the direction of rotation for unsealing is the opposite direction of the direction of rotation for the unsealing described hereinabove. Consequently, in the end, the direction of the initial rotation operation for unsealing can be made the counterclockwise direction, making it possible to prevent malfunctions. Furthermore, the direction of rotation for tightening the screwing part can similarly be the counterclockwise direction for the hinge-type cap shown in the fifth embodiment and so forth.

What is claimed is:

1. A cap comprising:

an inside plug, which, together with a container main body, forms an airtight space for enclosing contents, and which has a separating part for forming an aperture part in the airtight space; and an upper closure having a screwing part that enables attachment and detachment to and from the container main body by a rotation operation, and an opening portion that forms the aperture part by separating the separating part from the inside plug due to the rotation operation of the screwing part;

the separating part is an intended aperture part to be severed from the inside plug;

the opening portion includes a second threaded member, which relatively displaces the intended aperture part relative to an external portion extending outwardly from the intended aperture part by screwing together with a first threaded member disposed in the intended aperture part;

the opening portion includes a cutting member, which moves together with the screwing part, and which causes the external portion to relatively separate from the intended aperture part; and the second threaded member is a male thread, and is formed on an inner side of the first threaded member, which is a female thread, and the cutting member is formed outer side of the first threaded member.

2. The cap according to claim 1, wherein the cutting member has a blade-edged portion, which annularly protrudes downwardly from the bottom surface of the apex of the upper closure, and which has a cross-section that is acutely angled at a lower end thereof.

3. The cap according to claim 1, wherein the second threaded member is a male thread while the screwing part is a female thread, with the second threaded member being in either one of the opposite direction relationship with the screwing part or the forward direction relationship with the screwing part, and the rotation operation for operating the opening portion is rotation in either one of the direction that opens the upper closure or the direction that closes the upper closure.

4. The cap according to claim 1, wherein the inside plug is formed of a resin material, and a thin-walled score is formed between the separating part and an external portion extending outwardly from the separating part.

5. The cap according to claim 1, wherein the separating part is an internal sealing plug that can block the aperture part subsequent to unsealing.

6. The cap according to claim 1, wherein the second threaded member is a male thread while the screwing part is a female thread, with the second threaded member being in an opposite direction relationship with the screwing part, and the rotation operation for operating the opening portion is rotation in a direction that opens the upper closure.

7. The cap according to claim 1, wherein the second threaded member is a male thread while the screwing part is a female thread, with the second threaded member being in a forward direction relationship with the screwing part, and the rotation operation for operating the opening portion is rotation in a direction that closes the upper closure.

8. A covered container comprising:

a bottle, which constitutes the container main body, and which stores a liquid that is the contents; and the cap of claim 1, which is disposed on the mouth part of the bottle.

* * * * *